US007504187B2

(12) United States Patent
Yu et al.

(10) Patent No.: US 7,504,187 B2
(45) Date of Patent: Mar. 17, 2009

(54) MECHANICALLY ROBUST IMAGING MEMBER OVERCOAT

(75) Inventors: Robert C. U. Yu, Webster, NY (US); Stephen T. Avery, Rochester, NY (US); Kathleen M. Carmichael, Williamson, NY (US)

(73) Assignee: Xerox Corporation, Norwalk, CT (US)

( * ) Notice: Subject to any disclaimer, the term of this patent is extended or adjusted under 35 U.S.C. 154(b) by 298 days.

(21) Appl. No.: 11/495,717

(22) Filed: Jul. 28, 2006

(65) Prior Publication Data

US 2007/0059622 A1 Mar. 15, 2007

Related U.S. Application Data

(63) Continuation-in-part of application No. 11/227,639, filed on Sep. 15, 2005, now Pat. No. 7,422,831.

(51) Int. Cl.
*G03G 5/10* (2006.01)

(52) U.S. Cl. ..... 430/69; 430/58.05; 430/58.35; 430/127; 399/159

(58) Field of Classification Search ..... 430/69, 430/58.5, 58.35, 127; 399/159
See application file for complete search history.

(56) References Cited

U.S. PATENT DOCUMENTS

| | | | |
|---|---|---|---|
| 3,121,006 | A | 2/1964 | Middleton et al. |
| 3,820,989 | A | 6/1974 | Rule et al. |
| 3,837,851 | A | 9/1974 | Shattuck et al. |
| 3,895,944 | A | 7/1975 | Wiedemann et al. |
| 4,150,987 | A | 4/1979 | Anderson et al. |
| 4,245,021 | A | 1/1981 | Kazami et al. |
| 4,256,821 | A | 3/1981 | Enomoto et al. |
| 4,265,990 | A | 5/1981 | Stolka et al. |
| 4,278,746 | A | 7/1981 | Goto et al. |
| 4,286,033 | A | 8/1981 | Neyhart et al. |
| 4,291,110 | A | 9/1981 | Lee |
| 4,297,426 | A | 10/1981 | Sakai et al. |
| 4,315,982 | A | 2/1982 | Ishikawa et al. |
| 4,338,387 | A | 7/1982 | Hewitt |
| 4,338,388 | A | 7/1982 | Sakai et al. |
| 4,385,106 | A | 5/1983 | Sakai |
| 4,387,147 | A | 6/1983 | Sakai |
| 4,399,208 | A | 8/1983 | Takasu et al. |
| 4,587,189 | A | 5/1986 | Hor et al. |
| 4,654,284 | A | 3/1987 | Yu et al. |
| 4,664,995 | A | 5/1987 | Horgan et al. |
| 4,988,597 | A | 1/1991 | Spiewak et al. |
| 5,021,309 | A | 6/1991 | Yu |
| 5,069,993 | A | 12/1991 | Robinette et al. |
| 5,244,762 | A | 9/1993 | Spiewak et al. |
| 5,697,024 | A | 12/1997 | Mishra |
| 5,703,487 | A | 12/1997 | Mishra |
| 5,756,245 | A | 5/1998 | Esteghamatian et al. |
| 5,919,590 | A | 7/1999 | Yu et al. |
| 6,008,653 | A | 12/1999 | Popovic et al. |
| 6,072,011 | A | 6/2000 | Hoover |
| 6,119,536 | A | 9/2000 | Popovic et al. |
| 6,150,824 | A | 11/2000 | Mishra et al. |
| 6,214,514 | B1 | 4/2001 | Evans et al. |
| 6,528,226 | B1 | 3/2003 | Yu et al. |
| 2004/0018440 | A1 | 1/2004 | Lin et al. |
| 2004/0115545 | A1 | 6/2004 | Horgan et al. |
| 2004/0126684 | A1 | 7/2004 | Horgan et al. |
| 2005/0053854 | A1 | 3/2005 | Pai et al. |
| 2005/0233230 | A1* | 10/2005 | Carmichael et al. ..... 430/56 |
| 2007/0037081 | A1* | 2/2007 | Mishra et al. ..... 430/69 |

OTHER PUBLICATIONS

U.S. Appl. No. 11/315,800, filed Dec. 22, 2005.
U.S. Appl. No. 11/220,777, filed Sep. 7, 2005.
U.S. Appl. No. 11/320,459, filed Dec. 27, 2005.
U.S. Appl. No. 11/471,471, filed Jun. 20, 2006, Robert Yu et al.
U.S. Appl. No. 11/199,842, filed Aug. 9, 2005.
U.S. Appl. No. 11/227,639, filed Sep. 15, 2005.

* cited by examiner

*Primary Examiner*—John L Goodrow
(74) *Attorney, Agent, or Firm*—Pillsbury Winthrop Shaw Pittman LLP

(57) ABSTRACT

The presently disclosed embodiments relate in general to electrophotographic imaging members, such as layered photoreceptor structures, and processes for making and using the same. More particularly, the embodiments pertain to an improved electrophotographic imaging member having a protective overcoat layer comprising a low surface energy polymeric material to enhance the imaging member physical/mechanical function as well as render its service life extension and a process for making and using the member.

18 Claims, 2 Drawing Sheets

MECHANICALLY ROBUST IMAGING MEMBER OVERCOAT

RELATED APPLICATIONS

This application is a continuation-in-part application of utility application Ser. No. 11/227,639, filed on Sep. 15, 2005 now U.S. Pat. No. 7,422,831.

BACKGROUND

The presently disclosed embodiments are directed to an imaging member used in electrostatography. More particularly, the disclosure embodiments pertain to the preparation of an improved electrophotographic imaging member having a protective overcoat layer comprising a low surface energy polymeric material to enhance the imaging member physical/mechanical function as well as render its service life extension and a process for making and using the member.

In electrostatographic reproducing apparatuses, including digital, image on image, and contact electrostatic printing apparatuses, a light image of an original to be copied is typically recorded in the form of an electrostatic latent image upon a photosensitive member and the latent image is subsequently rendered visible by the application of electroscopic thermoplastic resin particles and pigment particles, or toner. Electrostatographic imaging members are well known in the art. Typical electrostatographic imaging members include, for example: (1) electrophotographic imaging member (photoreceptors) commonly utilized in electrophotographic (xerographic) processing systems; (2) electroreceptors such as ionographic imaging member belts for electrographic imaging systems; and (3) intermediate toner image transfer members such as an intermediate toner image transferring member which is used to remove the toner images from a photoreceptor surface and then transfer the very images onto a receiving paper.

Although the scope of the present invention covers the preparation of all types of flexible electrostatographic imaging members in either a rigid drum design or a flexible belt configuration, however for reason of simplicity, the embodiments and discussion thus followed hereinafter will be focused solely on and represented by electrophotographic imaging members in the flexible belt configuration. Electrophotographic flexible belt imaging members may include a photoconductive layer including a single layer or composite layers. The flexible belt electrophotographic imaging members may be seamless or seamed belts; and seamed belts are usually formed by cutting a rectangular sheet from a web, overlapping opposite ends, and welding the overlapped ends together to form a welded seam. Typical electrophotographic imaging member belts include a charge transport layer (CTL) and a charge generating layer on one side of a supporting substrate layer and an anticurl back coating coated onto the opposite side of the substrate layer. By comparison, a typical electrographic imaging member belt does, however, have a more simple material structure; it includes a dielectric imaging layer on one side of a supporting substrate and an anti-curl back coating on the opposite side of the substrate to render flatness. Since typical negatively-charged flexible electrophotographic imaging members exhibit undesirable upward imaging member curling after completion of coating the top outermost charge transport layer, an anticurl back coating, applied to the backside, is required to balance the curl. Thus, the application of anticurl back coating is necessary to provide the appropriate imaging member with desirable flatness.

One type of composite photoconductive layer used in xerography is illustrated in U.S. Pat. No. 4,265,990 which describes a negatively-charged photosensitive member having at least two electrically operative layers. One layer comprises a photoconductive layer which is capable of photogenerating holes and injecting the photogenerated holes into a contiguous charge transport layer (CTL). Generally, where the two electrically operative layers are supported on a conductive layer, the photoconductive layer is sandwiched between a contiguous CTL and the supporting conductive layer. Alternatively, the CTL of a positively-charged imaging member is sandwiched between the supporting electrode and a photoconductive layer. Photosensitive members having at least two electrically operative layers, as disclosed above, provide excellent electrostatic latent images when charged in the dark with a uniform negative electrostatic charge, exposed to a light image and thereafter developed with finely divided electroscopic marking particles. The resulting toner image is usually transferred to a suitable receiving member such as paper or to an intermediate transfer member which thereafter transfers the image to a receiving member such as paper.

In the case where the charge generating layer (CGL) is sandwiched between the outermost exposed CTL and the electrically conducting layer, the outer surface of the CTL is charged negatively and the conductive layer is charged positively. The CGL then should be capable of generating electron hole pair when exposed image wise and inject only the holes through the CTL. In the alternate case when the CTL is sandwiched between the CGL and the conductive layer, the outer surface of Gen layer is charged positively while conductive layer is charged negatively and the holes are injected through from the CGL to the CTL. The CTL should be able to transport the holes with as little trapping of charge as possible. In a typical flexible imaging member web like photoreceptor, the charge conductive layer may be a thin coating of metal on a flexible substrate support layer.

As more advanced, higher speed electrophotographic copiers, duplicators and printers were developed, however, degradation of image quality was encountered during extended cycling. The complex, highly sophisticated duplicating and printing systems operating at very high speeds have placed stringent requirements including narrow operating limits on photoreceptors. For example, the numerous layers used in many modern photoconductive imaging members must be highly flexible, adhere well to adjacent layers, and exhibit predictable electrical characteristics within narrow operating limits to provide excellent toner images over many thousands of cycles. One type of multilayered photoreceptor that has been employed as a belt in electrophotographic imaging systems comprises a substrate, a conductive layer, an optional blocking layer, an optional adhesive layer, a charge generating layer, a CTL and a conductive ground strip layer adjacent to one edge of the imaging layers, and an optional overcoat layer adjacent to another edge of the imaging layers. Such a photoreceptor usually further comprises an anticurl back coating layer on the side of the substrate opposite the side carrying the conductive layer, support layer, blocking layer, adhesive layer, charge generating layer, CTL and other layers.

Typical negatively-charged imaging member belts, such as flexible photoreceptor belt designs, are made of multiple layers comprising a flexible supporting substrate, a conductive ground plane, a charge blocking layer, an optional adhesive layer, a charge generating layer (CGL), and a charge transport layer (CTL). The CTL is usually the last layer to be coated to become the outermost exposed layer and is applied by solution coating then followed by drying the wet applied coating at elevated temperatures of about 115° C., and finally cooling it down to ambient room temperature of about 25° C. When a production web stock of several thousand feet of coated multilayered photoreceptor material is obtained after finishing the CTL coating through drying/cooling process, upward curling of the multilayered photoreceptor is observed.

This upward curling is a consequence of thermal contraction mismatch between the CTL and the substrate support. Since the CTL in a typical photoreceptor device has a coefficient of thermal contraction approximately 3.7 times greater than that of the flexible substrate support, the CTL exhibits a larger dimensional shrinkage than that of the substrate support as the imaging member web stock (after through elevated temperature heating/drying process) as it cools down to ambient room temperature. The exhibition of upward imaging member curling after completion of CTL coating is due to the consequence of the heating/cooling processing, according to the mechanism: (1) as the web stock carrying the wet applied CTL is dried at elevated temperature, dimensional contraction does occur when the wet CTL coating is losing its solvent during 115° C. elevated temperature drying, because the CTL at 115° C. still remains as a viscous liquid after losing its solvent. Since its glass transition temperature (Tg) is about 85° C., the CTL will flow to automatically re-adjust itself to compensate the losing of solvent and maintain its dimension; (2) as the CTL in a viscous liquid state is cooling down further and reaching its Tg at 85° C., the CTL instantaneously solidifies and adheres to the CGL because it has transformed itself from being a viscous liquid into a solid layer at its Tg; and (3) cooling down the solidified CTL of the imaging member web from 85° C. down to 25° C. room ambient will then cause the CTL to contract more than the substrate support since it has an approximately 3.7 times greater thermal coefficient of dimensional contraction than that of the substrate support. This dimensional contraction mis-match results in tension strain built-up in the CTL, at this instant, is pulling the imaging member upward to exhibit curling. If unrestrained at this point, the imaging member web stock will spontaneously curl upwardly into a 1.5-inch tube. To offset the curling, an anti-curl back coating is applied to the backside of the flexible substrate support, opposite to the side having the charge transport layer, and render the imaging member web stock with desired flatness.

Curling of a photoreceptor web is undesirable because it hinders fabrication of the web into cut sheets and subsequent welding into a belt. An anticurl back coating having a counter curling effect equal to and in the opposite direction to the applied layers is applied to the reverse side of the active imaging member to eliminate the overall curl of the coated device by offsetting the curl effect which is arisen from the mismatch of the thermal contraction coefficient between the substrate and the CTL, resulting in greater CTL dimensional shrinkage than that of the substrate. Although the anticurl back coating counters and balances the curl so as to promote the imaging member web to lay flat, nonetheless, common anticurl back coating formulations are not always providing satisfying dynamic imaging member belt performance result under a normal machine functioning condition; for example, exhibition of anticurl back coating wear and its propensity to cause electrostatic charging-up are the frequently seen problems to prematurely cut short the service life of a belt and requires its frequent costly replacement in the field.

Other layers of the imaging member, say for example the top outermost exposed CTL in particular of a negatively charge imaging member, do also subjected to and suffer from the machine operational conditions, such as exposure to high surface friction and extensive cycling. Such harsh conditions lead to wearing away and susceptibility of surface scratching of the CTL which otherwise adversely affect machine performance. Another imaging member functional problem associated with the CTL is its propensity to give rise to early development of surface filming due its high surface energy; CTL surface filming is undesirable because it does pre-maturely cause degradation of copy printout quality. Moreover, the outermost exposed CTL is also been found to exhibit early onset of surface cracking, as consequence of repetition of bending stress belt cyclic fatiguing, airborne chemical species exposure, and direct solvent contact, under a normal machine belt functioning condition. CTL cracking is a serious mechanical failure since the cracks do manifest themselves into defects in print-out copies. All these imaging member layers failures are major issues remained to be resolved, because they pre-maturely cut short the functional life of an imaging member and prevent it from reaching the belt life target; early imaging member functional failure does thereby require its frequent costly replacement in the field.

In U.S. Pat. No. 5,069,993, an exposed layer in an electrophotographic imaging member is provided with increase resistance to stress cracking and reduced coefficient of surface friction, without adverse effects on optical clarity and electrical performance. The layer contains a polymethylsiloxane copolymer and an inactive film forming resin binder. Various specific film forming resins for the anti-curl layer and adhesion promoters are disclosed.

U.S. Pat. No. 5,021,309 shows an electrophotographic imaging device, with material for an exposed anti-curl layer has organic fillers dispersed therein. The fillers provide coefficient of surface contact friction reduction, increased wear resistance, and improved adhesion of the anti-curl layer, without adversely affecting the optical and mechanical properties of the imaging member.

U.S. Pat. No. 5,919,590 shows An electrostatographic imaging member comprising a supporting substrate having an electrically conductive layer, at least one imaging layer, an anti-curl layer, an optional ground strip layer and an optional overcoat layer, the anti-curl layer including a film forming polycarbonate binder, an optional adhesion promoter, and optional dispersed particles selected from the group consisting of inorganic particles, organic particles, and mixtures thereof.

In U.S. Pat. No. 4,654,284 an electrophotographic imaging member is disclosed comprising a flexible support substrate layer having an anti-curl layer, the anti-curl layer comprising a film forming binder, crystalline particles dispersed in the film forming binder and a reaction product of a bifunctional chemical coupling agent with both the binder and the crystalline particles. The use of VITEL PE 100 in the anti-curl layer is described.

In U.S. Pat. No. 6,528,226 a process for preparing an imaging member is disclosed that includes applying an organic layer to an imaging member substrate, treating the organic layer and/or a backside of the substrate with a corona discharge effluent, and applying an overcoat layer to the organic layer and/or an anticurl back coating to the backside of the substrate.

The above prior art disclosures show that, while attempts to resolve CTL and anticurl back coating failures described above have been successful with providing a solution, often times the success is negated due to the creation of another set of problems. Therefore, there is an urgent need to provide improved imaging members that have mechanically robust outer layers to effect service life extension but without causing the introduction of other undesirable problems.

A number of current flexible electrophotographic imaging member belts are multilayered photoreceptor belts that, in a negative charging system, comprise a substrate support, an electrically conductive layer, an optional charge blocking layer, an optional adhesive layer, a charge generating layer (CGL), a charge transport layer (CTL), and an optional anti-curl back coating at the opposite side of the substrate support to render flatness. In such an imaging member belt design, the CTL is therefore the top outermost exposed layer. In a typical machine design, a flexible imaging member belt is mounted over and around a belt support module comprising numbers of belt support rollers, such that the top outermost CTL is exposed to all electrophotographic imaging subsystems interactions and charging devices chemical emission attack. Under normal machine electrophotographic imaging and cleaning operating conditions, the top exposed CTL surface of the flexible imaging member belt is constantly subjected to physical/mechanical/electrical/chemical species interactions, such as for example, the mechanical sliding actions of cleaning blade and cleaning brush, electrical charging devices corona effluents exposure, developer components, image formation toner particles, hard carrier particles, debris and loose $CaCO_3$ particles from receiving paper, and the like during dynamic belt cyclic motion. These interactions against the surface of the CTL have been found to cause surface scratching, abrasion, and rapid CTL surface wear; in some instances, the CTL wears away by as much as 10 micrometers after approximately 20,000 dynamic belt imaging cycles. Excessive CTL wear is a serious problem because it causes significant change in the charged field potential and adversely impacts copy printout quality. Another consequence of CTL wear is the decrease of CTL thickness alters the equilibrium of the balancing forces between the CTL and the anti-curl back coating and impacts imaging member belt flatness. The reduction of the CTL by wear causes the imaging member belt to curl downward at both edges. Edge curling in the belt is an important issue because it changes the distance between the belt surface and the charging device(s), causing non-uniform surface charging density which manifests itself as a "smile" print defect on paper copies. Such a print defect is characterized by lower intensity of print-images at the locations over both belt edges. The susceptibility of the CTL surface to scratches (caused by interaction against developer carrier beads and the hard $CaCO_3$ particles and debris from paper) has also been identified as a major imaging member belt functional failure since these scratches do manifest themselves as print defects in paper copies.

Moreover, since the current CTLs have a high surface energy of about 39 dynes/cm. The surface of the CTL is therefore prone to collect toner residues, dirt/debris particles, and additives from receiving papers. The eventual fusion of these collected species causes the formation of comets and filming over the outer surface of the CTL, further degrading the image quality of printouts. Another problem associated with high surface energy is that it also impedes the cleaning blade and cleaning brush function.

In a rigid electrophotographic imaging member drum utilizing a contact AC Bias Charging Roller (BCR), it has been found that ozone species attack on the CTL polymer binder is more pronounced because of the close vicinity of the BCR to the CTL of the imaging member drum.

The early exhibition of CTL failure (occurred in the imaging member of either in a flexible belt configuration or as a rigid drum design) does significantly cut short the intended service life of the imaging member and thereby requires frequent costly imaging member replacement in the field.

Thus, electrophotographic imaging members comprising a supporting substrate, having a conductive surface on one side, coated over with at least one photoconductive layer and coated on the other side of the supporting substrate with a conventional prior art anticurl back coating that does exhibit deficiencies which are undesirable in advanced automatic, cyclic electrophotographic imaging copiers, duplicators, and printers. While the above mentioned electrophotographic imaging members may be suitable or limited for their intended purposes, further improvement on these imaging members are desirable and urgently needed. For example, there continues to be the need for improvements in such systems, particularly for an imaging member belt that includes a mechanical robust, filming-free, and scratch resistant surface which sufficiently counters curling to render flatness, reduces friction, has superb wear resistance, provides lubricity to ease belt drive, nil or no wear debris, and eliminates electrostatic charge build-up problem, even in larger printing apparatuses.

According to aspects illustrated herein, there is provided an overcoating for an overcoat layer that addresses the shortcomings of traditional imaging layers discussed above. The present application is related to commonly assigned U.S. patent application Ser. No. 11/199,842, filed Aug. 9, 2005, entitled "Anti-curl Backing Layer for Electrostatographic Imaging Members," commonly assigned U.S. patent application Ser. No. 11/220,777, filed Sep. 7, 2005, entitled "Flexible Imaging Member with Improved Anticurl Back Coating," commonly assigned U.S. patent application Ser. No. 11/227,639, filed Sep. 15, 2005, entitled "Anticurl Backing Layer for Electrophotographic Imaging Members," and commonly assigned U.S. patent application Ser. No. 11/315,800, filed Dec. 22, 2005, entitled "Imaging Member," and commonly assigned U.S. Patent Application entitled "IMAGING MEMBER HAVING ADJUSTABLE FRICTION ANTICURL BACK COATING," to Yu et al. Ser. No. 11/471,471, filed on Jun. 20, 2006, which are all herein incorporated by reference. While the above applications provide anticurl back coatings that address the shortcomings of traditional anticurl back coatings, there is still a further need for improvements in the mechanical robustness of other imaging member layers.

SUMMARY

In accordance to other aspects illustrated herein, the present disclosure has focused on formulating a physically/mechanically robust overcoat layer that is added onto the CTL to render effective protection and eliminate the service life failures associated with the CTL of traditional electrophotographic imaging member belts discussed above.

According to one embodiment, there is provided an electrophotographic imaging member comprising a substrate; a charge generating layer disposed on the substrate; at least one charge transport layer disposed on the charge generating layer; and an overcoat layer disposed on the charge transport layer, the overcoat layer comprising a low surface energy modified polycarbonate polymer, the polymer being formed from a group consisting of modified Bisphenol A polycarbonate of poly(4,4'-isopropylidene diphenyl carbonate) having a small fraction of polydimethyl siloxane in the polymer back bone and having the following formula (I):

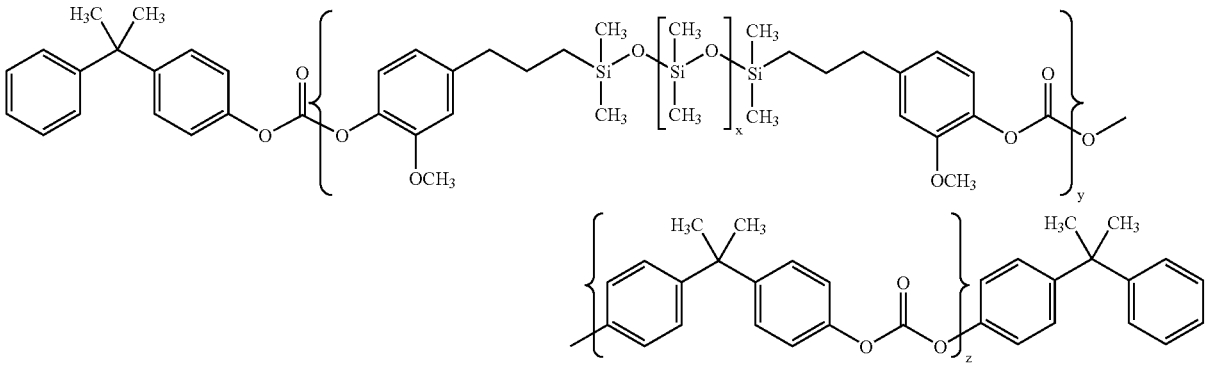

wherein x, y, and z are integers representing a number of repeating units, a modified Bisphenol Z polycarbonate of poly(4,4'-diphenyl-1,1'-cyclohexane carbonate) having a small fraction of polydimethyl siloxane in the polymer back bone and having the following formula (II):

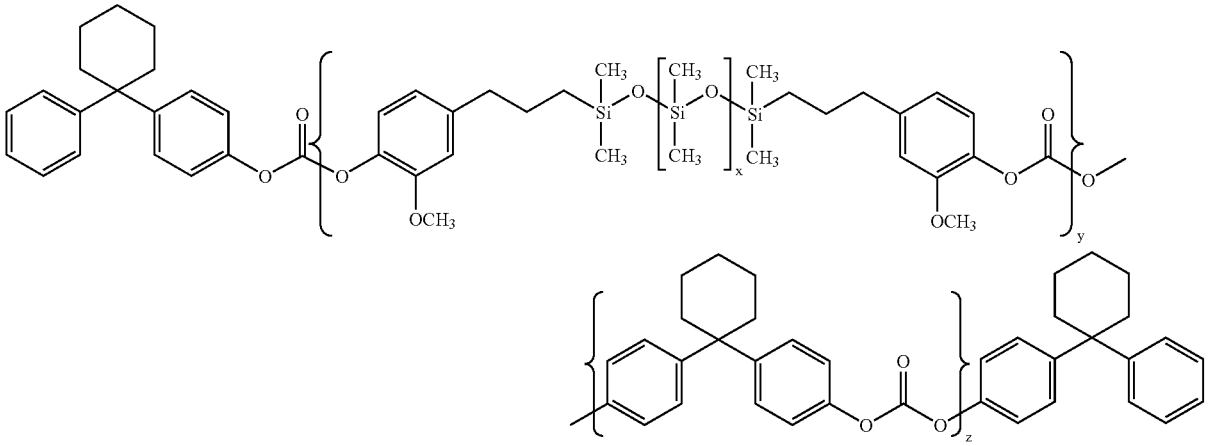

wherein x, y, and z are integers representing a number of repeating units, a modified Bishpenol C polycarbonate of poly(4,4'-isopropylidene diphenyl carbonate) having a small fraction of polydimethyl siloxane in the polymer back bone and having the following formula (III):

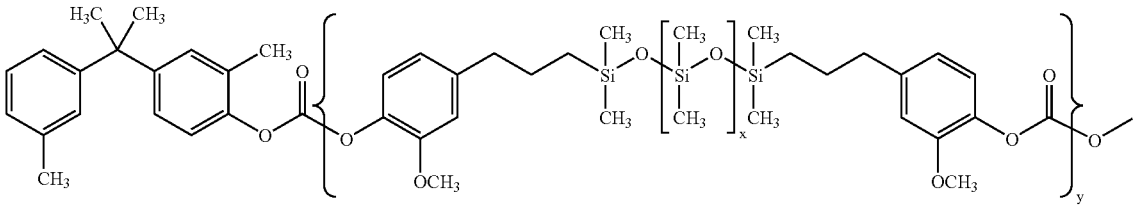

-continued

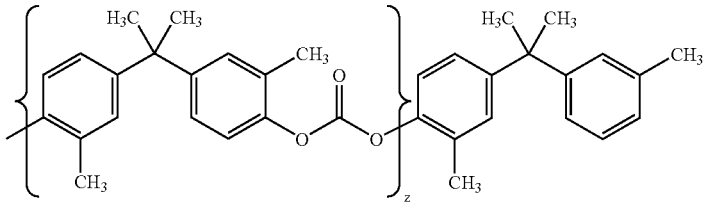

wherein x, y, and z are integers representing a number of repeating units, a modified Bisphenol Z polycarbonate of poly(4,4'-diphenyl-1,1'-cyclohexane carbonate) having a small fraction of polydimethyl siloxane in the polymer back bone and having the following formula (IV):

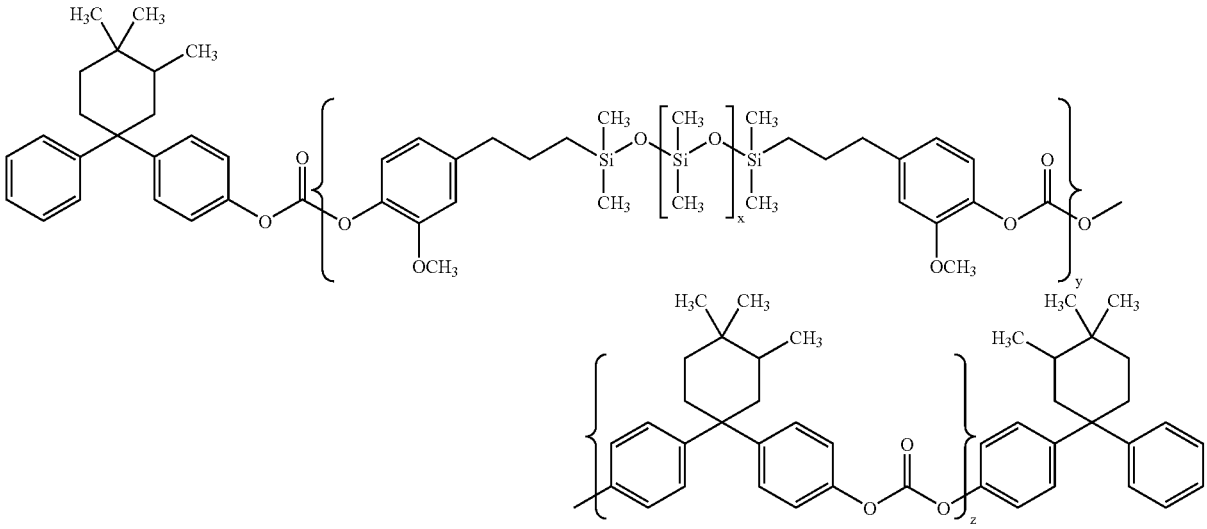

wherein x, y, and z are integers representing a number of repeating units, and mixtures thereof.

In another embodiment, there is provided an electrophotographic imaging member comprising a substrate; a charge generating layer disposed on the substrate; at least one charge transport layer disposed on the charge generating layer; an overcoat layer disposed on the charge transport layer, the overcoat layer comprising a low surface energy modified polycarbonate polymer, the polymer being formed from a group consisting of a modified Bisphenol A polycarbonate of poly(4,4'-isopropylidene diphenyl carbonate) having a small fraction of polydimethyl siloxane in the polymer back bone and having the following formula (I):

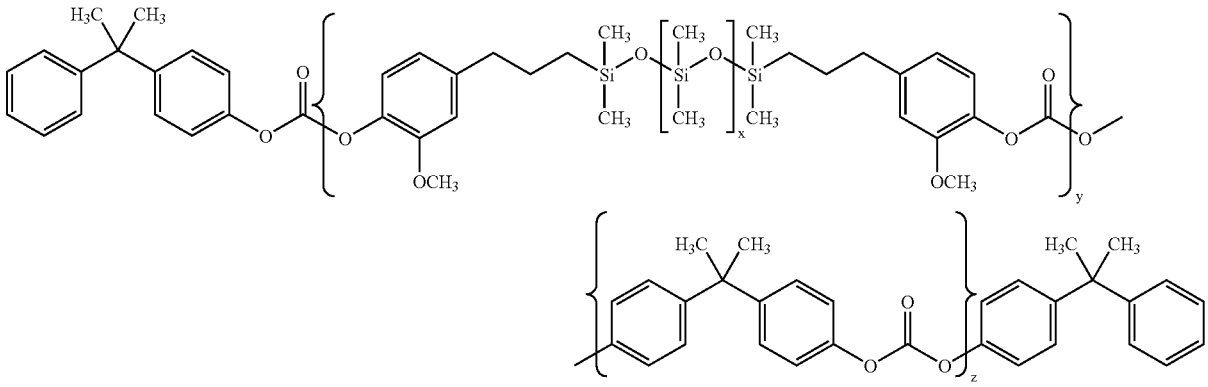

wherein x, y, and z are integers representing a number of repeating units, a modified Bisphenol Z polycarbonate of poly(4,4'-diphenyl-1,1'-cyclohexane carbonate) having a small fraction of polydimethyl siloxane in the polymer back bone and having the following formula (II):

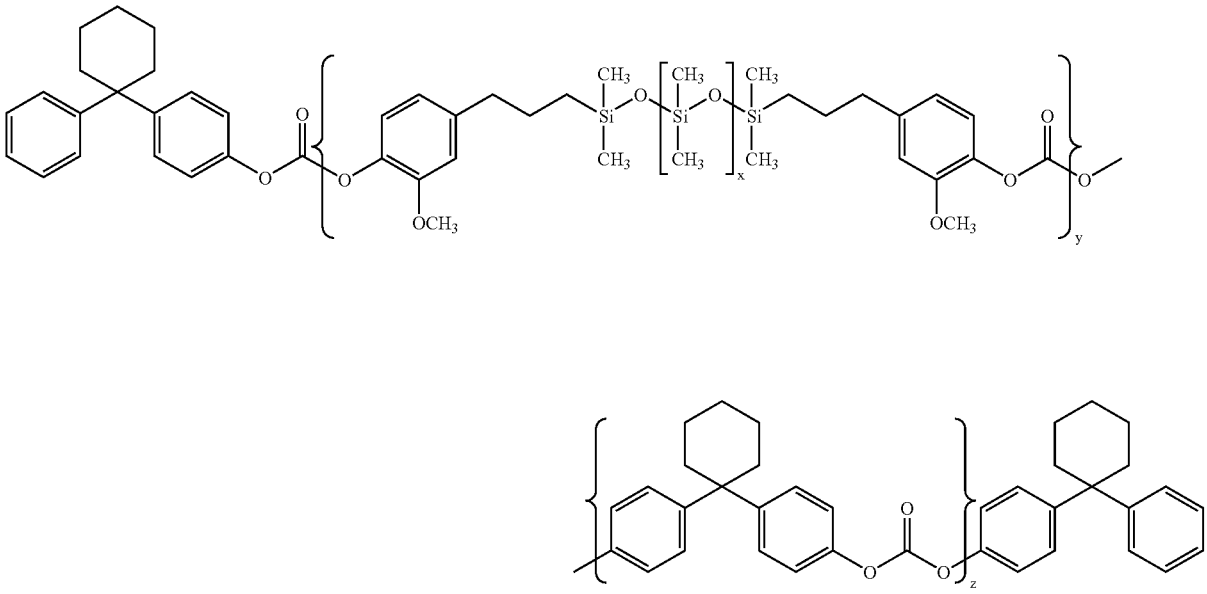

wherein x, y, and z are integers representing a number of repeating units, a modified Bisphenol Z polycarbonate of poly(4,4'-diphenyl-1,1'-cyclohexane carbonate) having a small fraction of polydimethyl siloxane in the polymer back bone and having the following formula (IV):

wherein x, y, and z are integers representing a number of repeating units, a modified Bishpenol C polycarbonate of poly(4,4'-isopropylidene diphenyl carbonate) having a small fraction of polydimethyl siloxane in the polymer back bone and having the following formula (III):

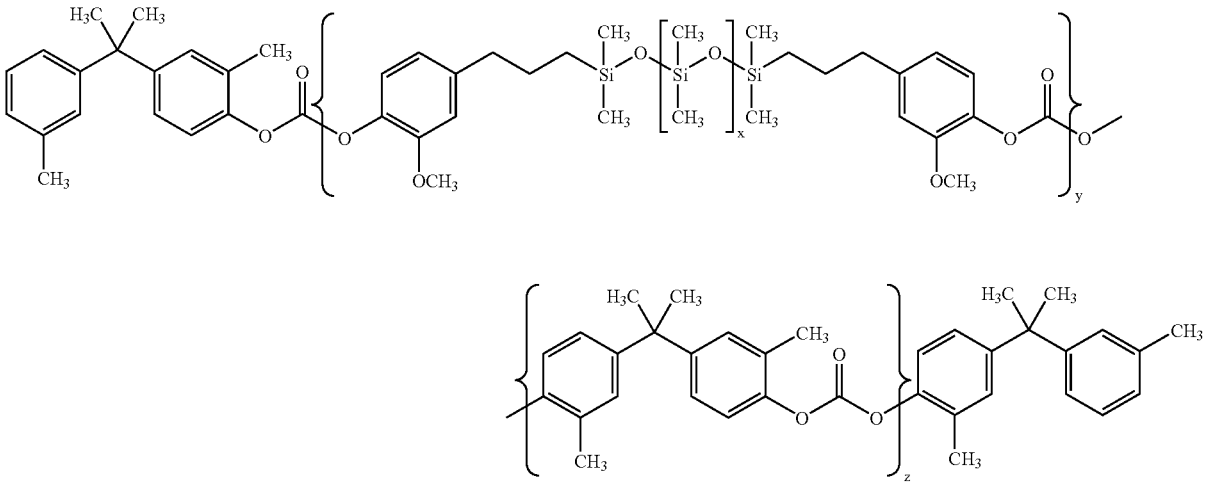

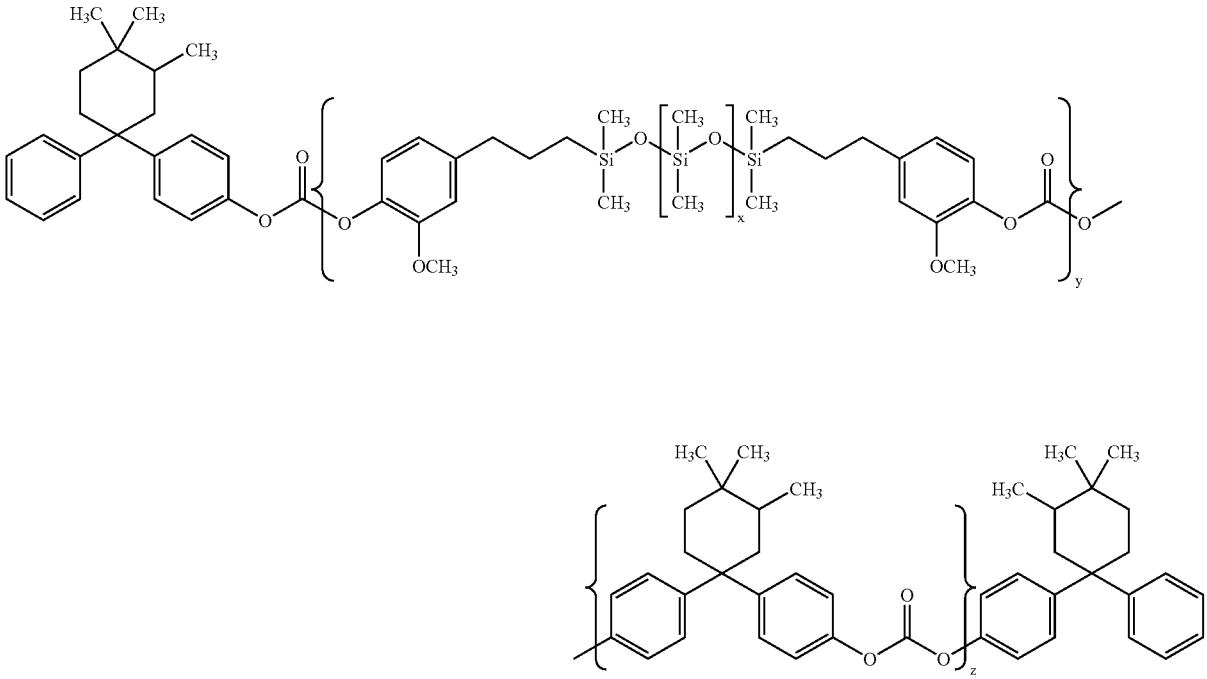

wherein x, y, and z are integers representing a number of repeating units, and mixtures thereof; and an anticurl back coating layer, the anticurl back coating layer comprising a low surface energy modified polycarbonate polymer, the polymer being formed from a group consisting of a modified Bisphenol A polycarbonate of poly(4,4'-isopropylidene diphenyl carbonate) having a small fraction of polydimethyl siloxane in the polymer back bone and having the following formula (I):

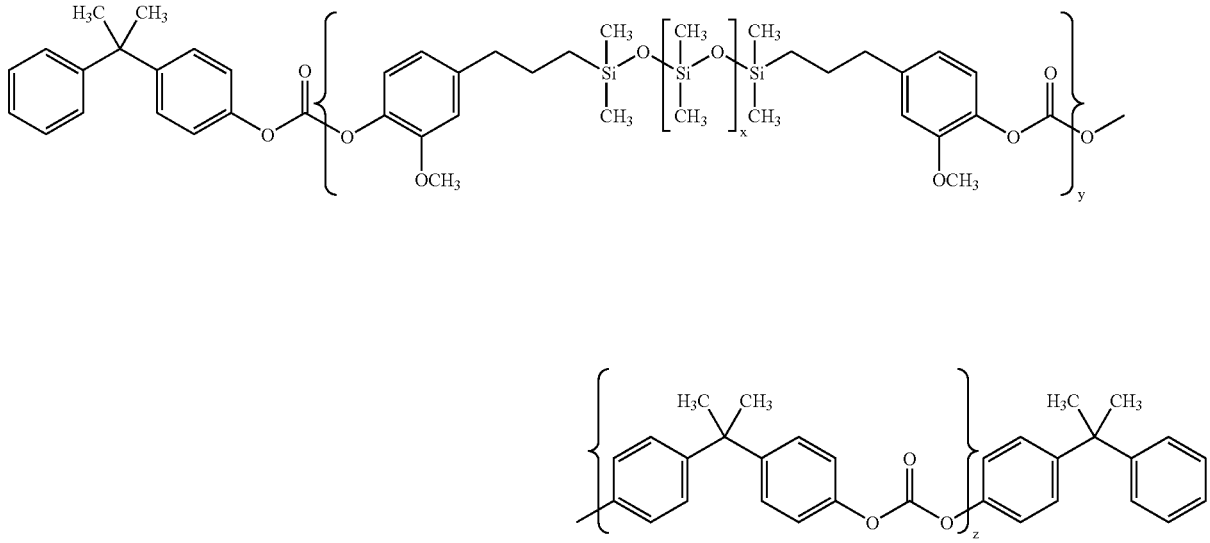

wherein x, y, and z are integers representing a number of repeating units, a modified Bisphenol Z polycarbonate of poly(4,4'-diphenyl-1,1'-cyclohexane carbonate) having a small fraction of polydimethyl siloxane in the polymer back bone and having the following formula (II):

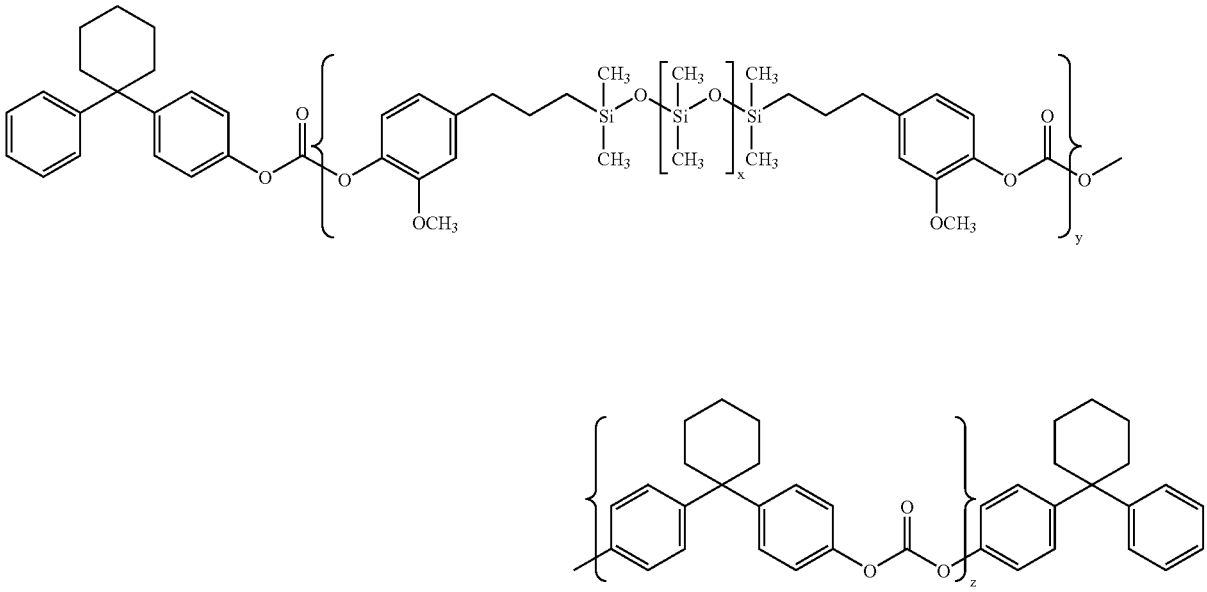

wherein x, y, and z are integers representing a number of repeating units, modified Bishpenol C polycarbonate of poly (4,4'-isopropylidene diphenyl carbonate) having a small fraction of polydimethyl siloxane in the polymer back bone and having the following formula (III):

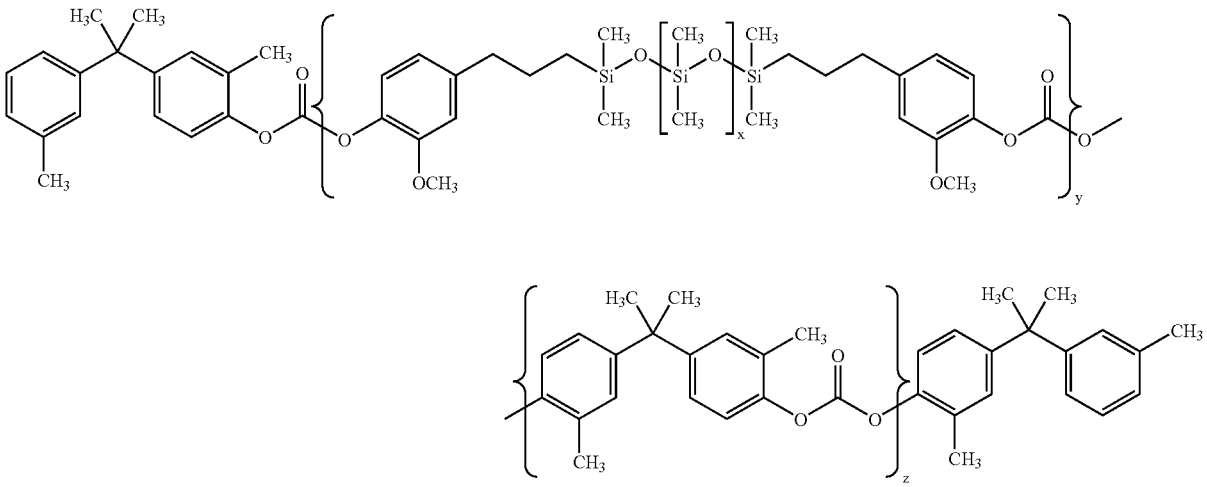

wherein x, y, and z are integers representing a number of repeating units, a modified Bisphenol Z polycarbonate of poly(4,4'-diphenyl-1,1'-cyclohexane carbonate) having a small fraction of polydimethyl siloxane in the polymer back bone and having the following formula (IV):

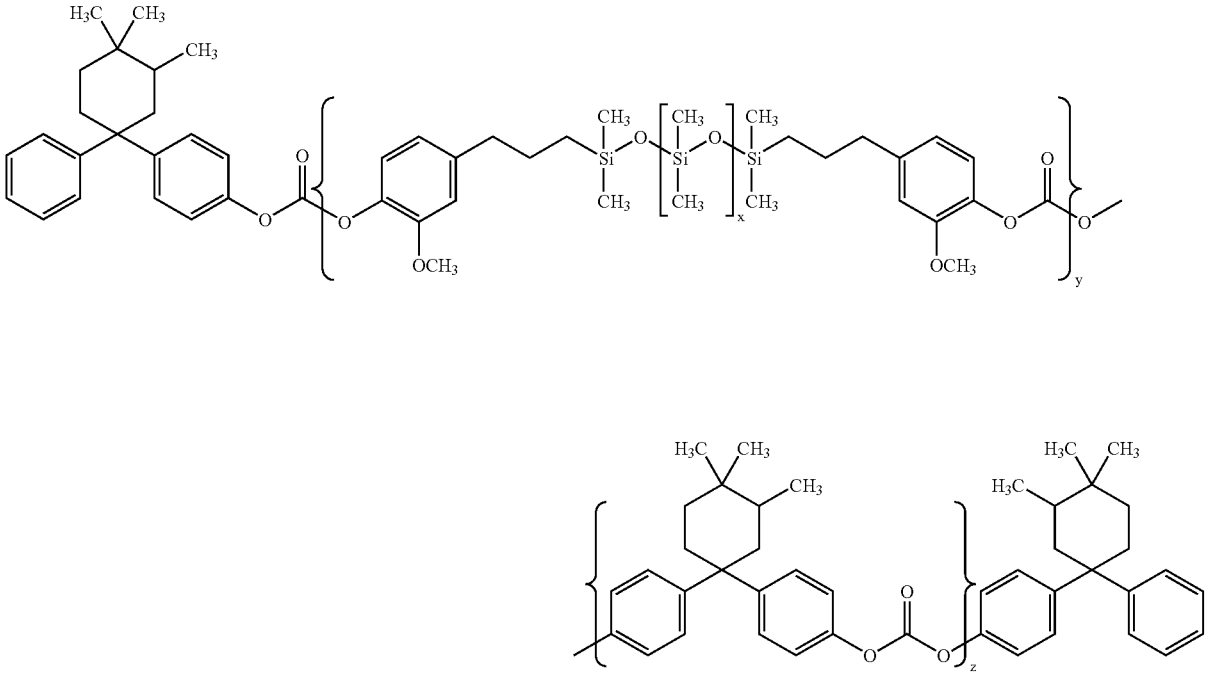

wherein x, y, and z are integers representing a number of repeating units, and mixtures thereof.

In yet another embodiment, there is provided an image forming apparatus for forming images on a recording medium comprising an imaging member having a charge retentive surface for receiving an electrostatic latent image thereon, wherein the imaging member comprises a substrate, a charge generating layer disposed on the substrate, at least one charge transport layer disposed on the charge generating layer, and an overcoat layer disposed on the charge transport layer, the overcoat layer comprising a low surface energy modified polycarbonate polymer, the polymer being formed from a group consisting of a modified Bisphenol A polycarbonate of poly(4,4'-isopropylidene diphenyl carbonate) having a small fraction of polydimethyl siloxane in the polymer back bone and having the following formula (I):

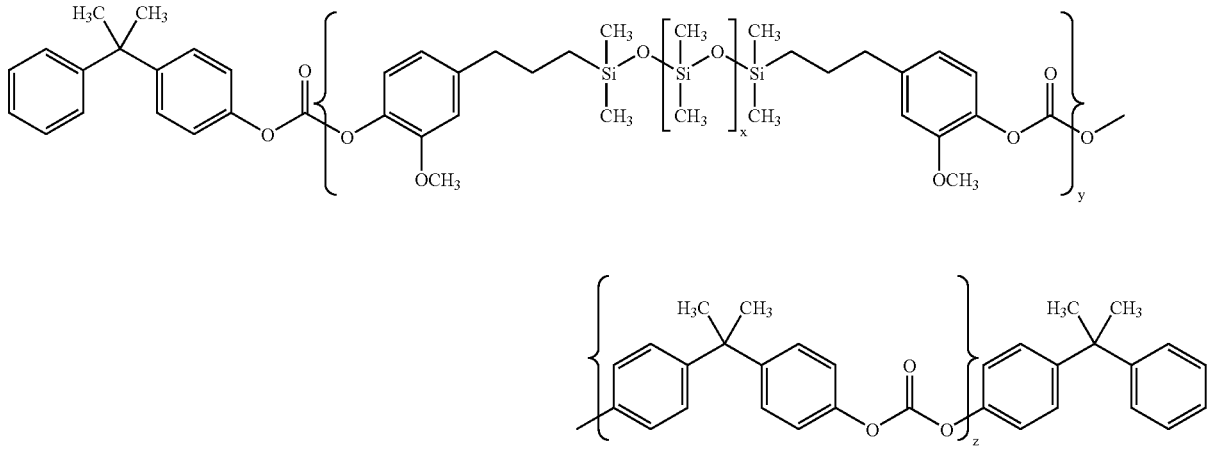

wherein x, y, and z are integers representing a number of repeating units, a modified Bisphenol Z polycarbonate of poly(4,4'-diphenyl-1,1'-cyclohexane carbonate) having a small fraction of polydimethyl siloxane in the polymer back bone and having the following formula (II):

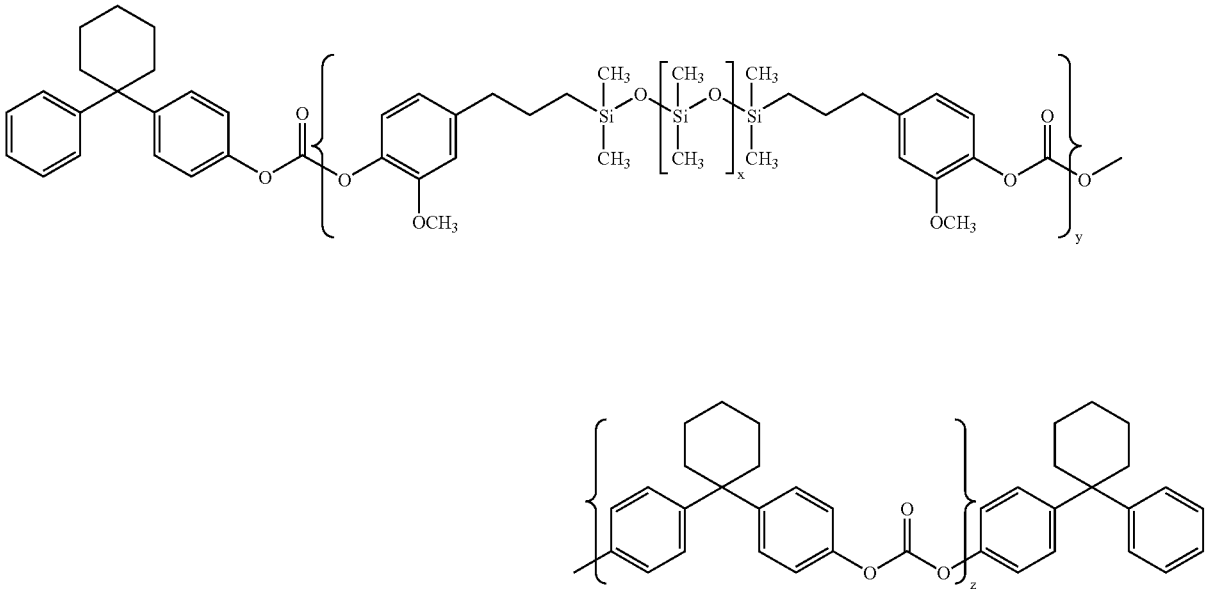

wherein x, y, and z are integers representing a number of repeating units, a modified Bishpenol C polycarbonate of poly(4,4'-isopropylidene diphenyl carbonate) having a small fraction of polydimethyl siloxane in the polymer back bone and having the following formula (III):

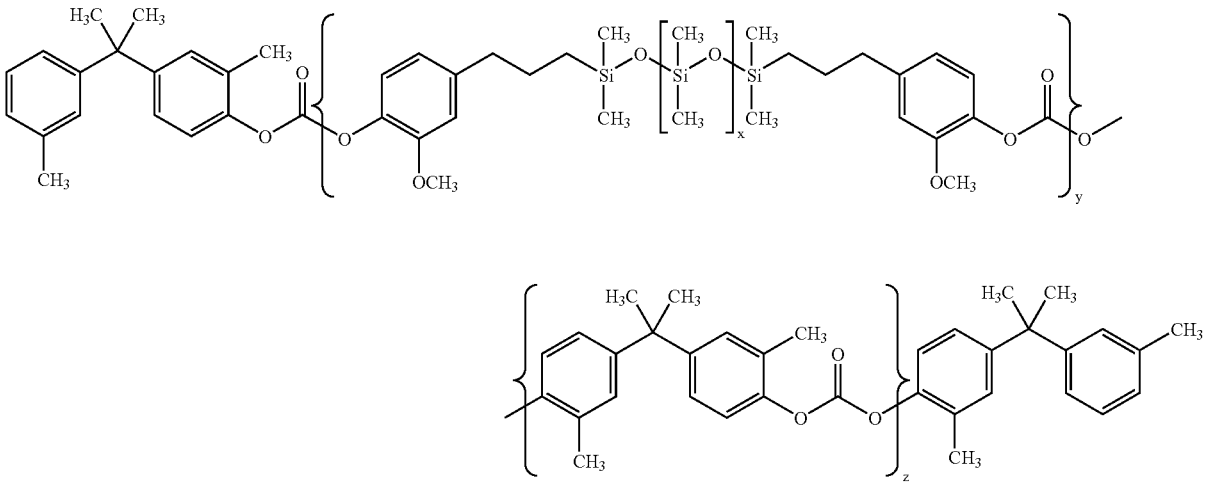

wherein x, y, and z are integers representing a number of repeating units, a modified Bisphenol Z polycarbonate of poly(4,4'-diphenyl-1,1'-cyclohexane carbonate) having a small fraction of polydimethyl siloxane in the polymer back bone and having the following formula (IV):

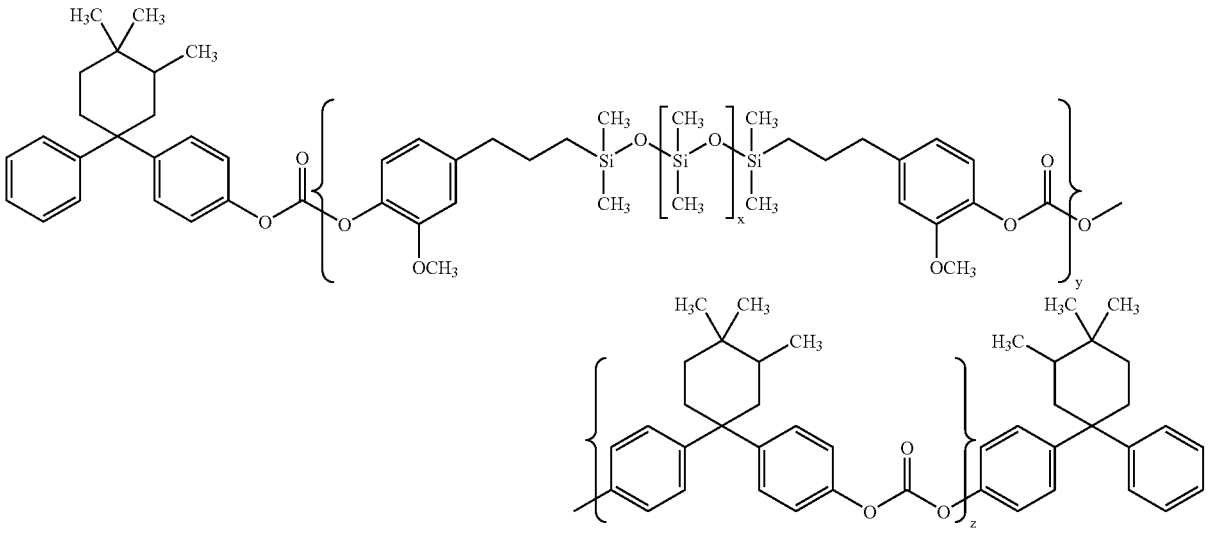

wherein x, y, and z are integers representing a number of repeating units, and mixtures thereof; a development component for applying a developer material to the charge-retentive surface; a transfer component for applying the developed image from the charge-retentive surface to a copy substrate; and a fusing component for fusing the developed image to the copy substrate.

BRIEF DESCRIPTION OF THE DRAWINGS

For a better understanding of the present invention, reference may be had to the accompanying figures.

DETAILED DESCRIPTION

In the following description, reference is made to the accompanying drawings, which form a part hereof and which illustrate several embodiments of the present invention. It is understood that other embodiments may be utilized and structural and operational changes may be made without departure from the scope of the present invention.

Figure 1:
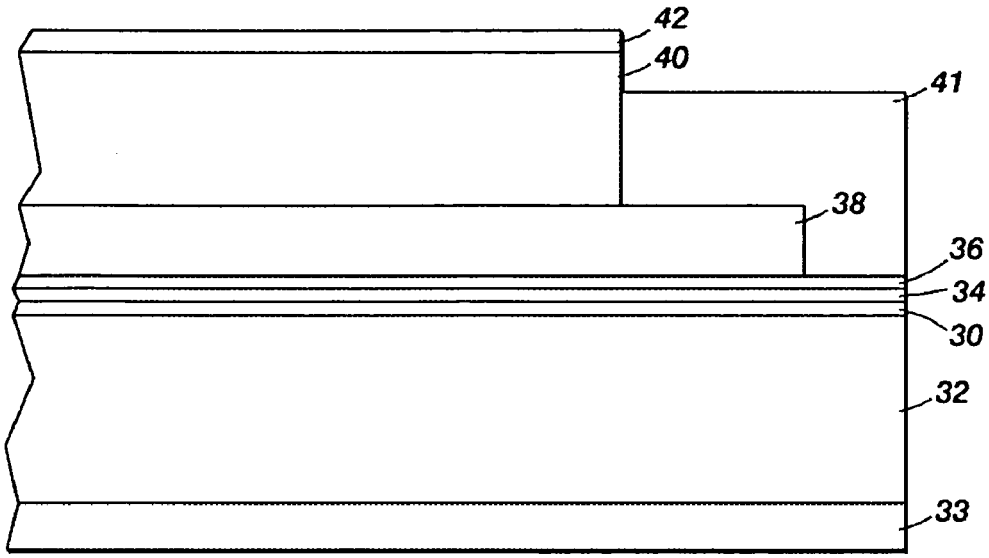
FIG. 1 is a cross-sectional view of a multilayered electrophotographic imaging member according to an embodiment of the present disclosure.

An exemplary embodiment of the negatively charged flexible electrophotographic imaging member of the present disclosure is illustrated in FIG. 1. The substrate 32 has an optional conductive layer 30. An optional hole blocking layer 34 can also be applied, as well as an optional adhesive layer 36. The charge generating layer 38 is located between the adhesive layer 36 and the charge transport layer 40. An optional ground strip layer 41 operatively connects the charge generating layer 38 and the charge transport layer 40 to the conductive layer 30, and an optional overcoat layer 42. An anti-curl backing layer 33 is applied to the side of the substrate 32 opposite from the electrically active layers to render imaging member flatness.

Other layers of the imaging member may include, for example, an optional ground strip layer 28, applied to one edge of the imaging member to promote electrical continuity with the conductive layer 30 through the hole blocking layer 34. An anticurl back coating layer 33 of the present invention may be formed on the backside of the support substrate 32. A conductive ground plane, which is typically a thin metallic layer, for example a 10 nanometer thick titanium coating, may be deposited over the substrate 32 by vacuum deposition or sputtering process. The layers 34, 36, 38, 40 and 42 may be separately and sequentially deposited, on to the surface of conductive ground plane 30 of substrate 32, as wet coating layer of solutions comprising a solvent, with each layer being dried before deposition of the next. Anticurl back coating 33 is also solution coated, but is applied to the back side (the side opposite to all the other layers) of substrate 32, to render imaging member flatness.

The Substrate

The photoreceptor support substrate 32 may be opaque or substantially transparent, and may comprise any suitable organic or inorganic material having the requisite mechanical properties. The entire substrate can comprise the same material as that in the electrically conductive surface, or the electrically conductive surface can be merely a coating on the substrate. Any suitable electrically conductive material can be employed. Typical electrically conductive materials include copper, brass, nickel, zinc, chromium, stainless steel, conductive plastics and rubbers, aluminum, semitransparent aluminum, steel, cadmium, silver, gold, zirconium, niobium, tantalum, vanadium, hafnium, titanium, nickel, chromium, tungsten, molybdenum, paper rendered conductive by the inclusion of a suitable material therein or through conditioning in a humid atmosphere to ensure the presence of sufficient water content to render the material conductive, indium, tin, metal oxides, including tin oxide and indium tin oxide, and the like. It could be single metallic compound or dual layers of different metals and or oxides.

The substrate 32 can also be formulated entirely of an electrically conductive material, or it can be an insulating material including inorganic or organic polymeric materials, such as, MYLAR, a commercially available biaxially oriented polyethylene terephthalate from DuPont, or polyethylene naphthalate available as KALEDEX 2000, with a ground plane layer comprising a conductive titanium or titanium/zirconium coating, otherwise a layer of an organic or inorganic material having a semiconductive surface layer, such as indium tin oxide, aluminum, titanium, and the like, or exclusively be made up of a conductive material such as, aluminum, chromium, nickel, brass, other metals and the like. The thickness of the support substrate depends on numerous factors, including mechanical performance and economic considerations. The substrate 32 the substrate may have a number of many different configurations, such as, for example, a plate, a drum, a scroll, an endless flexible belt, and the like. In one embodiment, the substrate is in the form of a seamed flexible belt.

The thickness of the substrate 32 depends on numerous factors, including flexibility, mechanical performance, and economic considerations. The thickness of the support substrate 32 may range from about 50 micrometers to about 3,000 micrometers. In embodiments of flexible photoreceptor belt preparation, the thickness of substrate 32 is from about 50 micrometers to about 200 micrometers for optimum flexibility and to effect minimum induced photoreceptor surface bending stress when a photoreceptor belt is cycled around small diameter rollers in a machine belt support module, for example, 19 millimeter diameter rollers.

An exemplary substrate support 32 is not soluble in any of the solvents used in each coating layer solution, is optically transparent, and is thermally stable up to a high temperature of about 150° C. A typical substrate support 32 used for imaging member fabrication has a thermal contraction coefficient ranging from about $1\times10^{-5}$/° C. to about $3\times10^{-5}$/° C. and a Young's Modulus of between about $5\times10^{-5}$ psi ($3.5\times10^{-4}$ Kg/cm$^2$) and about $7\times10^{-5}$ psi ($4.9\times10^{-4}$ Kg/cm$^2$).

The Conductive Layer

The conductive ground plane layer 30 may vary in thickness depending on the optical transparency and flexibility desired for the electrophotographic imaging member. When a photoreceptor flexible belt is desired, the thickness of the conductive layer 30 on the support substrate 32, for example, a titanium and/or zirconium conductive layer produced by a sputtered deposition process, typically ranges from about 2 nanometers to about 75 nanometers to enable adequate light transmission for proper back erase, and in embodiments from about 10 nanometers to about 20 nanometers for an optimum combination of electrical conductivity, flexibility, and light transmission. Generally, for rear erase exposure, a conductive layer light transparency of at least about 15 percent is desirable. The conductive layer need not be limited to metals. The conductive layer 30 may be an electrically conductive metal layer which may be formed, for example, on the substrate by any suitable coating technique, such as a vacuum depositing or sputtering technique. Typical metals suitable for use as conductive layer 30 include aluminum, zirconium, niobium, tantalum, vanadium, hafnium, titanium, nickel, stainless steel, chromium, tungsten, molybdenum, combinations thereof, and the like. Where the entire substrate is an electrically conductive metal, the outer surface thereof can perform the function of an electrically conductive layer and a separate electrical conductive layer may be omitted. Other examples of conductive layers may be combinations of materials such as conductive indium tin oxide as a transparent layer for light having a wavelength between about 4000 Angstroms and about 9000 Angstroms or a conductive carbon black dispersed in a plastic binder as an opaque conductive layer.

The illustrated embodiment will be described in terms of a substrate layer 10 comprising an insulating material including inorganic or organic polymeric materials, such as, MYLAR with a ground plane layer 30 comprising an electrically conductive material, such as titanium or titanium/zirconium, coating over the substrate layer 32.

The Hole Blocking Layer

A hole blocking layer 34 may then be applied to the substrate 32 or to the layer 30, where present. Any suitable positive charge (hole) blocking layer capable of forming an effective barrier to the injection of holes from the adjacent conductive layer 30 into the photoconductive or photogenerating layer may be utilized. The charge (hole) blocking layer may include polymers, such as, polyvinylbutyral, epoxy resins, polyesters, polysiloxanes, polyamides, polyurethanes, HEMA, hydroxylpropyl cellulose, polyphosphazine, and the like, or may comprise nitrogen containing siloxanes or silanes, or nitrogen containing titanium or zirconium compounds, such as, titanate and zirconate. The hole blocking layer may have a thickness in wide range of from about 5 nanometers to about 10 micrometers depending on the type of material chosen for use in a photoreceptor design. Typical hole blocking layer materials include, for example, trimethoxysilyl propylene diamine, hydrolyzed trimethoxysilyl propyl ethylene diamine, N-beta-(aminoethyl) gamma-aminopropyl trimethoxy silane, isopropyl 4-aminobenzene sulfonyl di(dodecylbenzene sulfonyl) titanate, isopropyl di(4-aminobenzoyl)isostearoyl titanate, isopropyl tri(N-ethylaminoethylamino)titanate, isopropyl trianthranil titanate, isopropyl tri(N,N-dimethylethylamino)titanate, titanium-4-amino benzene sulfonate oxyacetate, titanium 4-aminobenzoate isostearate oxyacetate, (gamma-aminobutyl) methyl diethoxysilane which has the formula $[H_2N(CH_2)_4]CH_3Si(OCH_3)_2$, and (gamma-aminopropyl)methyl diethoxysilane, which has the formula $[H_2N(CH_2)_3]CH_{33}Si(OCH_3)_2$, and combinations thereof, as disclosed, for example, in U.S. Pat. Nos. 4,338,387; 4,286,033; and 4,291,110, incorporated herein by reference in their entireties. A preferred hole blocking layer comprises a reaction product between a hydrolyzed silane or mixture of hydrolyzed silanes and the oxidized surface of a metal ground plane layer. The oxidized surface inherently forms on the outer surface of most metal ground plane layers when exposed to air after deposition. This combination enhances electrical stability at low RH. Other suitable charge blocking layer polymer compositions are also described in U.S. Pat. No. 5,244,762 which is incorporated herein by reference in its entirety. These include vinyl hydroxyl ester and vinyl hydroxy amide polymers wherein the hydroxyl groups have been partially modified to benzoate and acetate esters which modified polymers are then blended with other unmodified vinyl hydroxy ester and amide unmodified polymers. An example of such a blend is a 30 mole percent benzoate ester of poly (2-hydroxyethyl methacrylate) blended with the parent polymer poly (2-hydroxyethyl methacrylate). Still other suitable charge blocking layer polymer compositions are described in U.S. Pat. No. 4,988,597, which is incorporated herein by reference in its entirety. These include polymers containing an alkyl acrylamidoglycolate alkyl ether repeat unit. An example of such an alkyl acrylamidoglycolate alkyl ether containing polymer is the copolymer poly(methyl acrylamidoglycolate methyl ether-co-2-hydroxyethyl methacrylate). The disclosures of these U.S. Patents are incorporated herein by reference in their entireties.

The hole blocking layer 34 can be continuous or substantially continuous and may have a thickness of less than about 10 micrometers because greater thicknesses may lead to undesirably high residual voltage. In aspects of the exemplary embodiment, a blocking layer of from about 0.005 micrometers to about 2 micrometers gives optimum electrical performance. The blocking layer may be applied by any suitable conventional technique, such as, spraying, dip coating, draw bar coating, gravure coating, silk screening, air knife coating, reverse roll coating, vacuum deposition, chemical treatment, and the like. For convenience in obtaining thin layers, the blocking layer may be applied in the form of a dilute solution, with the solvent being removed after deposition of the coating by conventional techniques, such as, by vacuum, heating, and the like. Generally, a weight ratio of blocking layer material and solvent of between about 0.05:100 to about 5:100 is satisfactory for spray coating.

The Adhesive Interface Layer

An optional separate adhesive interface layer 36 may be provided. In the embodiment illustrated in FIG. 1, an interface layer 36 is situated intermediate the blocking layer 34 and the charge generator layer 38. The interface layer may include a copolyester resin. Exemplary polyester resins which may be utilized for the interface layer include polyarylatepolyvinylbutyrals, such as ARDEL POLYARYLATE (U-100) commercially available from Toyota Hsutsu Inc., VITEL PE-1200, VITEL PE-2200, VITEL PE-2200D, and VITEL PE-2222, all from Bostik, 49,000 polyester from Rohm Hass, polyvinyl butyral, and the like. The adhesive interface layer 36 may be applied directly to the hole blocking layer 34. Thus, the adhesive interface layer 36 in embodiments is in direct contiguous contact with both the underlying hole blocking layer 34 and the overlying charge generator layer 38 to enhance adhesion bonding to provide linkage. In yet other embodiments, the adhesive interface layer 36 is entirely omitted.

Any suitable solvent or solvent mixtures may be employed to form a coating solution of the polyester for the adhesive interface layer 36. Typical solvents include tetrahydrofuran, toluene, monochlorobenzene, methylene chloride, cyclohexanone, and the like, and mixtures thereof. Any other suitable and conventional technique may be used to mix and thereafter apply the adhesive layer coating mixture to the hole blocking layer. Typical application techniques include spraying, dip coating, roll coating, wire wound rod coating, and the like. Drying of the deposited wet coating may be effected by any suitable conventional process, such as oven drying, infra red radiation drying, air drying, and the like.

The adhesive interface layer 36 may have a thickness of from about 0.01 micrometers to about 900 micrometers after drying. In embodiments, the dried thickness is from about 0.03 micrometers to about 1 micrometer.

The Charge Generating Layer

The photogenerating (e.g., charge generating) layer 38 may thereafter be applied to the adhesive layer 36. Any suitable charge generating binder layer 38 including a photogenerating/photoconductive material, which may be in the form of particles and dispersed in a film forming binder, such as an inactive resin, may be utilized. Examples of photogenerating materials include, for example, inorganic photoconductive materials such as amorphous selenium, trigonal selenium, and selenium alloys selected from the group consisting of selenium-tellurium, selenium-tellurium-arsenic, selenium arsenide and mixtures thereof, and organic photoconductive materials including various phthalocyanine pigments such as the X-form of metal free phthalocyanine, metal phthalocyanines such as vanadyl phthalocyanine and copper phthalocyanine, hydroxy gallium phthalocyanines, chlorogallium phthalocyanines, titanyl phthalocyanines, quinacridones, dibromo anthanthrone pigments, benzimidazole perylene, substituted 2,4-diamino-triazines, polynuclear aromatic quinones, and the like dispersed in a film forming polymeric binder. Selenium, selenium alloy, benzimidazole perylene, and the like and mixtures thereof may be formed as a continuous, homogeneous photogenerating layer. Benzimidazole perylene compositions are well known and described, for example, in U.S. Pat. No. 4,587,189, the entire disclosure thereof being incorporated herein by reference. Multi-photogenerating layer compositions may be utilized where a photoconductive layer enhances or reduces the properties of the photogenerating layer. Other suitable photogenerating materials known in the art may also be utilized, if desired. The photogenerating materials selected should be sensitive to activating radiation having a wavelength between about 400 and about 900 nm during the imagewise radiation exposure step in an electrophotographic imaging process to form an electrostatic latent image. For example, hydroxygallium phthalocyanine absorbs light of a wavelength of from about 370 to about 950 nanometers, as disclosed, for example, in U.S. Pat. No. 5,756,245.

Any suitable inactive resin materials may be employed as a binder in the photogenerating layer 38, including those described, for example, in U.S. Pat. No. 3,121,006, the entire disclosure thereof being incorporated herein by reference. Typical organic resinous binders include thermoplastic and thermosetting resins such as one or more of polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl butyral, polyvinyl acetate, polysiloxanes, polyacrylates, polyvinyl acetals, polyamides, polyimides, amino resins, phenylene oxide resins, terephthalic acid resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrene-butadiene copolymers, vinylidenechloride/vinylchloride copolymers, vinylacetate/vinylidene chloride copolymers, styrene-alkyd resins, and the like.

An exemplary film forming polymer binder is PCZ400 (poly(4,4'-dihydroxy-diphenyl-1-1-cyclohexane) which has a $M_W$=40,000 and is available from Mitsubishi Gas Chemical Corporation.

The photogenerating material can be present in the resinous binder composition in various amounts. Generally, from about 5 percent by volume to about 90 percent by volume of the photogenerating material is dispersed in about 10 percent by volume to about 95 percent by volume of the resinous binder, and more specifically from about 20 percent by volume to about 30 percent by volume of the photo generating material is dispersed in about 70 percent by volume to about 80 percent by volume of the resinous binder composition.

The photogenerating layer 38 containing the photogenerating material and the resinous binder material generally ranges in thickness of from about 0.1 micrometer to about 5 micrometers, for example, from about 0.3 micrometers to about 3 micrometers when dry. The photogenerating layer thickness is generally related to binder content. Higher binder content compositions generally employ thicker layers for photogeneration.

The Charge Transport Layer

The charge transport layer (CTL) 40 is thereafter applied over the charge generating layer 38 and may include any suitable transparent organic polymer or non-polymeric material capable of supporting the injection of photogenerated holes or electrons from the charge generating layer 38 and capable of allowing the transport of these holes/electrons through the CTL to selectively discharge the surface charge on the imaging member surface. In one embodiment, the CTL 40 not only serves to transport holes, but also protects the charge generating layer 38 from abrasion or chemical attack and may therefore extend the service life of the imaging member. The CTL 40 can be a substantially non-photoconductive material, but one which supports the injection of photogenerated holes from the charge generation layer 18. The layer 40 is normally transparent in a wavelength region in which the electrophotographic imaging member is to be used when exposure is effected therethrough to ensure that most of the incident radiation is utilized by the underlying charge generating layer 38. The CTL should exhibit excellent optical transparency with negligible light absorption and neither charge generation nor discharge if any, when exposed to a wavelength of light useful in xerography, e.g., 400 to 900 nanometers. In the case when the photoreceptor is prepared with the use of a transparent substrate 32 and also a transparent conductive layer 30, image wise exposure or erase may be accomplished through the substrate 32 with all light passing through the back side of the substrate. In this case, the materials of the layer 40 need not transmit light in the wavelength region of use if the charge generating layer 38 is sandwiched between the substrate and the CTL 40. The CTL 40 in conjunction with the charge generating layer 38 is an insulator to the extent that an electrostatic charge placed on the CTL is not conducted in the absence of illumination. The CTL 40 should trap minimal charges as the charge pass through it during the printing process.

The CTL 40 may include any suitable charge transport component or activating compound useful as an additive molecularly dispersed in an electrically inactive polymeric material to form a solid solution and thereby making this material electrically active. The charge transport component may be added to a film forming polymeric material which is otherwise incapable of supporting the injection of photo generated holes from the generation material and incapable of allowing the transport of these holes there through. This converts the electrically inactive polymeric material to a material capable of supporting the injection of photogenerated holes from the charge generation layer 38 and capable of allowing the transport of these holes through the CTL 40 in order to discharge the surface charge on the CTL. The charge transport component typically comprises small molecules of an organic compound which cooperate to transport charge between molecules and ultimately to the surface of the CTL.

Any suitable inactive resin binder soluble in methylene chloride, chlorobenzene, or other suitable solvent may be employed in the CTL. Exemplary binders include polyesters, polyvinyl butyrals, polycarbonates, polystyrene, polyvinyl formals, and combinations thereof. The polymer binder used for the CTLs may be, for example, selected from the group consisting of polycarbonates, poly(vinyl carbazole), polystyrene, polyester, polyarylate, polyacrylate, polyether, polysulfone, combinations thereof, and the like. Exemplary polycarbonates include poly(4,4'-isopropylidene diphenyl carbonate), poly(4,4'-diphenyl-1,1'-cyclohexane carbonate), and combinations thereof. The molecular weight of the binder can be for example, from about 20,000 to about 1,500,000. One exemplary binder of this type is a MAKROLON binder, which is available from Bayer AG and comprises poly(4,4'-isopropylidene diphenyl) carbonate having a weight average molecular weight of about 120,000.

Exemplary charge transport components include aromatic polyamines, such as aryl diamines and aryl triamines. Exemplary aromatic diamines include N,N'-diphenyl-N,N'-bis(alkylphenyl)-1,1'-biphenyl-4,4-diamines, such as mTBD, which has the formula (N,N'-diphenyl-N,N'-bis[3-methylphenyl]-[1,1'-biphenyl]-4,4'-diamine); N,N'-diphenyl-N,N'-bis(chlorophenyl)-1,1'-biphenyl-4,4'-diamine; and N,N'-bis-(4-methylphenyl)-N,N'-bis(4-ethylphenyl)-1,1'-3,3'-dimethylbiphenyl)-4,4'-diamine (Ae-16), N,N'-bis-(3,4-dimethylphenyl)-4,4'-biphenyl amine (Ae-18), and combinations thereof.

Other suitable charge transport components include pyrazolines, such as 1-[lepidyl-(2)]-3-(p-diethylaminophenyl)-5-(p-diethylaminophenyl)pyrazoline, as described, for example, in U.S. Pat. Nos. 4,315,982, 4,278,746, 3,837,851, and 6,214,514, substituted fluorene charge transport molecules, such as 9-(4'-dimethylaminobenzylidene)fluorene, as described in U.S. Pat. Nos. 4,245,021 and 6,214,514, oxadiazole transport molecules, such as 2,5-bis(4-diethylaminophenyl)-1,3,4-oxadiazole, pyrazoline, imidazole, triazole, as described, for example in U.S. Pat. No. 3,895,944, hydrazones, such as p-diethylaminobenzaldehyde (diphenylhydrazone), as described, for example in U.S. Pat. Nos. 4,150,987 4,256,821, 4,297,426, 4,338,388, 4,385,106, 4,387,147, 4,399,207, 4,399,208, 6,124,514, and tri-substituted methanes, such as alkyl-bis(N,N-dialkylaminoaryl)methanes, as described, for example, in U.S. Pat. No. 3,820,989. The disclosures of all of these patents are incorporated herein be reference in their entireties.

The concentration of the charge transport component in layer 40 may be, for example, at least about 5 weight percent and may comprise up to about 60 weight percent. The concentration or composition of the charge transport component may vary through layer 40, as disclosed, for example, in U.S. application Ser. No. 10/736,864, filed Dec. 16, 2003, entitled "Imaging Members," by Anthony M. Horgan, et al., which was published on Jul. 1, 2004, as Application Serial No. 2004/0126684; U.S. application Ser. No. 10/320,808, filed Dec. 16, 2002, entitled "Imaging Members," by Anthony M. Horgan, et al., which was published on Jun. 17, 2004, as Application Serial No. 2004/0115545, and U.S. application Ser. No. 10/655,882, filed Sep. 5, 2003, entitled "Dual charge transport layer and photoconductive imaging member including the same," by Damodar M. Pai, et al., which was published on Mar. 10, 2005 as Application Serial No. 2005/0053854, the disclosures of which are incorporated herein by reference in their entireties.

In one exemplary embodiment, layer 40 comprises an average of about 10-60 weight percent N,N'-diphenyl-N,N'-bis(3-methylphenyl)-1,1'-biphenyl-4,4'-diamine, such as from about 30-50 weight percent N,N'-diphenyl-N,N'-bis(3-methylphenyl)-1,1'-biphenyl-4,4'-diamine.

The CTL 40 is an insulator to the extent that the electrostatic charge placed on the CTL is not conducted in the absence of illumination at a rate sufficient to prevent formation and retention of an electrostatic latent image thereon. In general, the ratio of the thickness of the CTL 40 to the charge generator layer 38 is maintained from about 2:1 to about 200:1 and in some instances as great as about 400:1.

Additional aspects relate to the inclusion in the CTL 40 of variable amounts of an antioxidant, such as a hindered phenol. Exemplary hindered phenols include octadecyl-3,5-di-tert-butyl-4-hydroxyhydrociannamate, available as IRGANOX I-1010 from Ciba Specialty Chemicals. The hindered phenol may be present at about 10 weight percent based on the concentration of the charge transport component. Other suitable antioxidants are described, for example, in above-mentioned U.S. application Ser. No. 10/655,882 incorporated by reference.

In one specific embodiment, the CTL 40 is a solid solution including a charge transport component, such as N,N'-diphenyl-N,N'-bis(3-methylphenyl)-1,1'-biphenyl-4,4'-diamine, molecularly dissolved in a polycarbonate binder, the binder being either a poly(4,4'-isopropylidene diphenyl carbonate) or a poly(4,4'-diphenyl-1,1'-cyclohexane carbonate). The CTL may have a Young's Modulus in the range of from about $2.5\times10^{-5}$ psi ($1.7\times10^{-4}$ Kg/cm$^2$) to about $4.5\times10^{-5}$ psi ($3.2\times10^{-4}$ Kg/cm$^2$) and a thermal contraction coefficient of between about $6\times10^{-5}$/° C. and about $8\times10^{-5}$/° C.

The thickness of the CTL 40 can be from about 5 micrometers to about 200 micrometers, e.g., from between about 15 micrometers and about 40 micrometers. The CTL may comprise dual layers or multiple layers with different concentration of charge transporting components.

In embodiments, the CTL 40, may also contain inorganic or organic fillers to impart further wear resistant enhancement. Inorganic fillers may include, but are not limited to, silica, metal oxides, metal carbonate, metal silicates, and the like. Examples of organic fillers include, but are not limited to, KEVLAR, stearates, fluorocarbon (PTFE) polymers such as POLYMIST and ZONYL, waxy polyethylene such as ACUMIST and ACRAWAX, fatty amides such as PETRAC erucamide, oleamide, and stearamide, and the like. Either micron-sized or nano-sized inorganic or organic particles can be used in the fillers to achieve mechanical property reinforcement.

Figure 2:
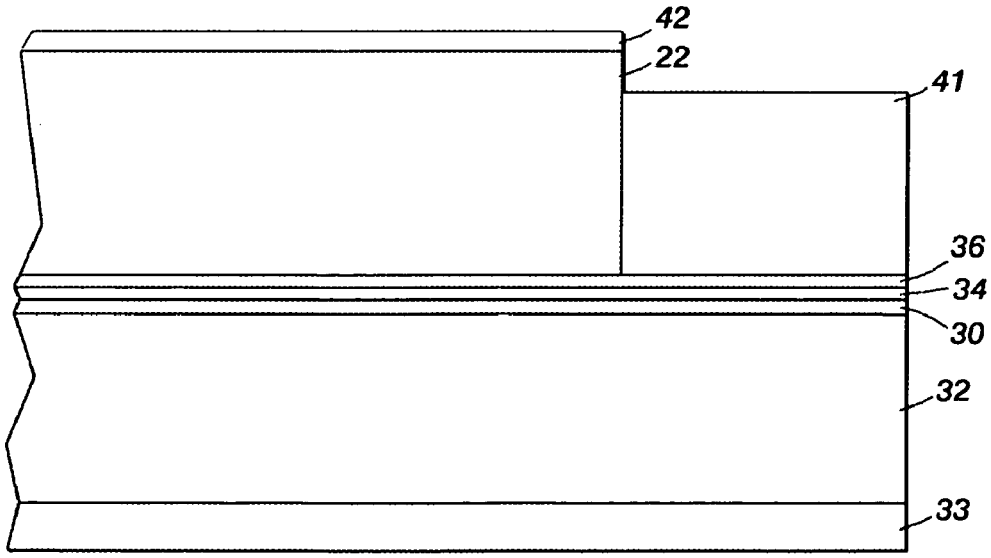
FIG. 2 is a cross-sectional view of a multilayered electrophotographic imaging member according to another embodiment of the present disclosure.

As an alternative to the two discretely separated charge transport 40 and charge generation layers 38, a single imaging layer 22 having both charge generating and charge transporting capability may be employed, as shown in FIG. 2, with other layers of the imaging member being formed as described above. The imaging layer 22 may comprise a single electrophotographically active layer capable of retaining an electrostatic charge in the dark during electrostatic charging, imagewise exposure and image development, as disclosed, for example, in U.S. application Ser. No. 10/202,296, filed Jul. 23, 2002, entitled "Imaging Members," by Liang-Bih Lin, et al., published Jan. 29, 2004, as Application No. 2004/0018440. The single imaging layer 22 may include charge transport molecules in a binder, similar to those of the CTL 40 and optionally may also include a photogenerating/photoconductive material, similar to those of the layer 38 described above.

The Ground Strip Layer

Other layers such as conventional ground strip layer 41 is conveniently applied by co-coating process along with the application of CTL. A typical ground strip layer 41 does include, for example, conductive particles dispersed in a film forming binder may be applied to one edge of the imaging member to promote electrical continuity with the conductive layer 30 through the hole blocking layer 34. Ground strip layer may include any suitable film forming polymer binder and electrically conductive particles. Typical ground strip materials include those enumerated in U.S. Pat. No. 4,664,995, the entire disclosure of which is incorporated by reference herein. The ground strip layer may have a thickness from about 7 micrometers to about 42 micrometers, for example, from about 14 micrometers to about 23 micrometers.

The Anticurl Back Coating

Since the CTL 40 can have a substantial thermal contraction mismatch compared to that of the substrate support 32, the prepared flexible electrophotographic imaging member may exhibit spontaneous upward curling due to the result of larger dimensional contraction in the CTL than the substrate support 32, as the imaging member cools down from its Tg to room ambient temperature after the heating/drying processes of the applied wet CTL coating. An anti-curl back coating 33 can be applied to the back side of the substrate support 32 (which is the side opposite the side bearing the electrically active coating layers) in order to render the prepared imaging member with desired flatness.

Generally, anticurl back coating comprise a polymer 33, typically a bisphenol A polycarbonate, and an adhesion promoter dissolved in a solvent and coated on the reverse side of the active photoreceptor. The anticurl back coating must adhere well to the substrate 32, for example polyethylenenaphthalate (KADELEX) substrate, of the imaging member, for the entire duration of the functional life of the imaging member belt, while being subjected to xerographic cycling over rollers and backer bars within the copier or printer.

Bisphenol A is a chemical building block primarily used to make polycarbonate plastic and epoxy resins. A bisphenol A polycarbonate polymer is available as MAKROLON from Bayer Corp. (Wilmington, Mass.) and is the film forming polymeric material used in conventional prior art anticurl back coating formulation. The molecular structure of MAKROLON, having a weight average molecular weight of about 130,000, is given in below formula:

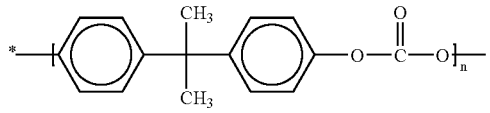

where n indicates the degree of polymerization. In the alternative, poly(4,4'-diphenyl-1,1'-cyclohexane carbonate) may also be used to for the anticurl back coating in place of MAKROLON. The molecular structure of poly(4,4'-diphenyl-1,1'-cyclohexane carbonate), having a weight average molecular weight of about between about 20,000 and about 200,000, is given in the formula shown below:

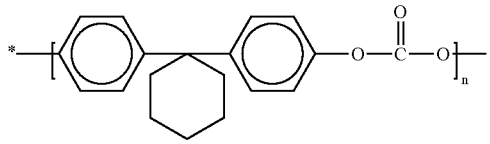

where n indicates the degree of polymerization.

In a conventional prior art anticurl back coating, an adhesion promoter of copolyester is included in its material matrix to provide adhesion bonding enhancement to the substrate support. Satisfactory adhesion promoter content is from about 0.2 percent to about 20 percent but preferably from about 2 percent to about 10 percent by weight, based on the total weight of the anticurl back coating The adhesion promoter may be any known in the art, such as for example, VITEL PE2200 which is available from Bostik, Inc. (Middleton, Mass.). VITEL PE2200 is a copolyester resin of terephthalic acid and isophthalic acid with ethylene glycol and dimethyl propanediol. A solvent such as methylene chloride may be used in embodiments. The anticurl back coating has a thickness of from about 5 micrometers to about 50 micrometers, but preferably between about 10 micrometers and about 20 micrometers, in further embodiments. A generic or conventional anticurl back coating formulation is a 92:8 ratio of polymer to adhesive dissolved at 9 percent by weight in a solvent. Specifically, the formulation may be 92:8 ratio of MAKROLON polymer to VITEL PE2200 adhesive. The polymer and adhesive may be dissolved at 9 percent by weight in a solvent of methylene chloride.

The Overcoat Layer

Additional aspects is related to the inclusion/addition of an overcoat 42 for protecting the imaging member surface from abrasion, scratch, and wear, since the outermost exposed CTL 40 is highly susceptible to mechanical failure and material degradation under a machine service environment as a result of constant mechanical interaction against cleaning blade, cleaning brush, dirt debris, carrier beads from developer, loose $CaCO_3$ particles from paper, and chemical attack from corona effluent species. Moreover, the CTL of typical imaging member belts is also found to be prone to develop surface filming and exacerbate its early onset of print quality failure, preventing the imaging member belt from reaching its service life target. Therefore, the formulation of the disclosure overcoat 42 is then further required to possess the surface filming suppression capability as well.

Consequently, when an overcoat layer is employed to effect resolution of all these CTL associated issues, it should be formulated to comprise a low surface energy polymer that is selected not only does provide surface lubricity to render its surface contact friction reduction, but to also have intrinsic mechanical property enhancement as well to impact abrasion/wear/scratch resistance.

In one embodiment of present disclosure, there is provided an electrophotographic imaging member comprising a flexible substrate with a conducting layer, at least one imaging layer positioned on a first side of the substrate; an optional ground strip layer on the at least one imaging layer; an protective overcoat layer applied over the at least one imaging layer; and an anticurl back coating positioned on a second side of the substrate opposite to the at least one imaging layer to render imaging member flatness. In this imaging member, the overcoat layer 42 of this disclosure is created from a low surface energy modified polycarbonate which is being formed by modifying a bisphenol A polycarbonate of poly(4,4'-isopropylidene diphenyl carbonate) to just contain a small fraction of polydimethyl siloxane in the polymer back bone. The molecular structure of the low surface energy modified bisphenol A polycarbonate is described as Formula (I) below:

of Formula (I) is a commercial material available as LEXAN EXL 1414-T from GE Plastics Canada, Ltd (Mississauga, ONTL5N 5P2) and are described in U.S. Pat. No. 6,072,011, which is hereby incorporated by reference. The LEXAN EXL1414-T bisphenol A polycarbonate does contain a very small fractions of surface energy lowering PDMS segments in its polymer chain backbone. This low surface energy polymers are formed by modifying a bisphenol A polycarbonate poly(4,4'-isopropylidene diphenyl carbonate) to contain of from about 2 to about 10 percent by weight of siloxane segments in its chain backbone and has a molecular weight of about 25,000. In further embodiments, the siloxane is present in an amount of from about 2 to about 8 percent by weight of the total weight of the overcoat.

Since this PDMS-containing bisphenol A polycarbonate polymer, LEXAN EXL 1414-T, contains only very small fractions of surface energy lowering PDMS segments in its polymer chain backbone to render a coating layer with surface energy lowering and lubricity effects. Furthermore, the LEXAN EXL 1414-T has physical/mechanical/thermal properties (Tg of 150° C., a coefficient of thermal expansion of $6.6\times10^{-6}$/° C., Young's Modulus of $3.2\times10^{5}$ psi, and is readily soluble in methylene chloride or other conventional organic solvents for ease of coating solution preparation) equal to those of Makrolon, it can therefore be conveniently used for protective overcoating application overcoat the CTL; it may as well be used as an alternate anticurl back coating formulation for direct Makrolon replacement.

In an alternative embodiment, there is provided an electrophotographic imaging member comprising a flexible substrate with a conducting layer, at least one imaging layer with an overcoat positioned on a first side of the substrate; an optional ground strip layer on the at least one imaging layer; and an anticurl back coating positioned on a second side of the substrate opposite to the at least one imaging layer with the overcoat. Both the overcoat 42 of the present disclosure and the anticurl back coating 33 are formulated from an alternate low surface energy polycarbonate modified from bisphenol Z polycarbonate, which is being formed by modifying a poly Formula (I)

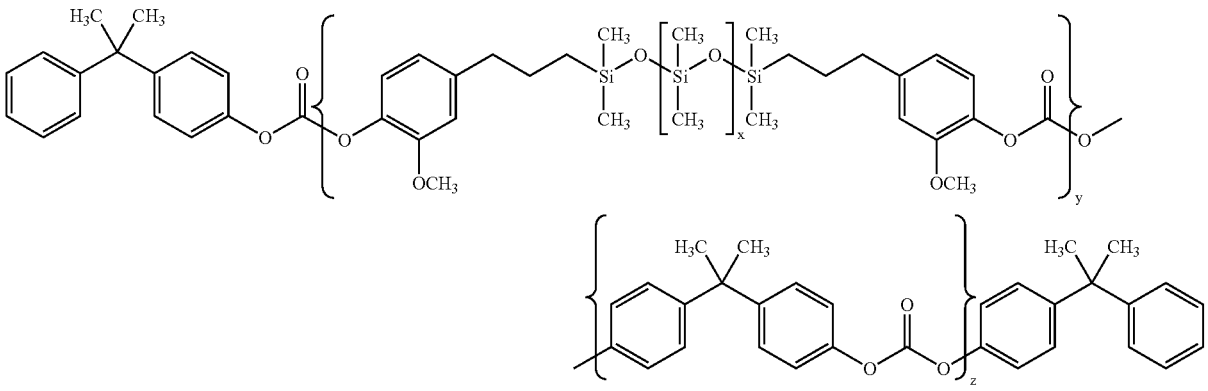

where x, y and z are integers representing the number of repeating units.

To improve the anticurl back coating 33 function, it may also be formulated with this very same low surface energy polycarbonate and along with the addition of an optional adhesion promoter to enhance its bonding strength to the substrate support 32. The low surface energy polycarbonate (4,4'-diphenyl-1,1'-cyclohexane carbonate), to just contain a small fraction of polydimethyl siloxane in the polymer back bone. However, the anticurl back coating 33 formulated may also include an optional adhesion promoter to increase its adhesion bonding to the substrate support 32. The molecular structure of this modified bisphenol Z polycarbonate is provided as follow in Formula (II):

Formula (II)

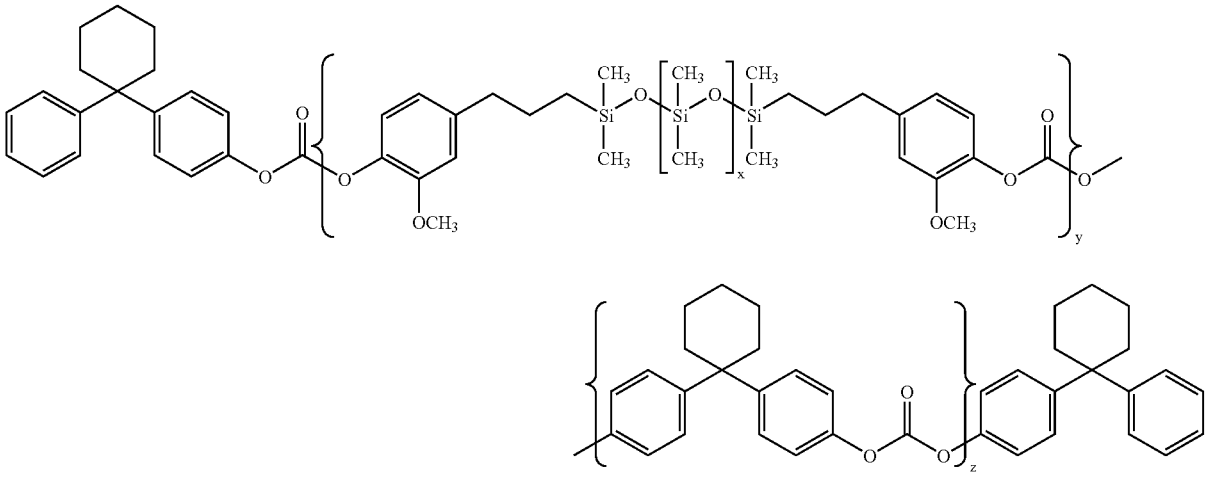

wherein x, y and z are integers representing the number of repeating units.

In another alternative embodiment, there is provided an electrophotographic imaging member comprising a flexible substrate with a conducting layer, at least one imaging layer with an overcoat positioned on a first side of the substrate; an optional ground strip layer on the at least one imaging layer; and an anticurl back coating positioned on a second side of the substrate opposite to the at least one imaging layer with the overcoat. This overcoat 42 of the present disclosure is formulated from another alternative low surface energy polycarbonate which is modified from a bisphenol C polycarbonate being formed by modifying the modified poly(4,4'-isopropylidene diphenyl carbonate) to contain a small fraction of polydimethyl siloxane in its polymer back bone. The molecular structure of this modified bisphenol C polycarbonate for use in disclosure overcoat 42 formulation is provided below in Formula (III):

Formula (III)

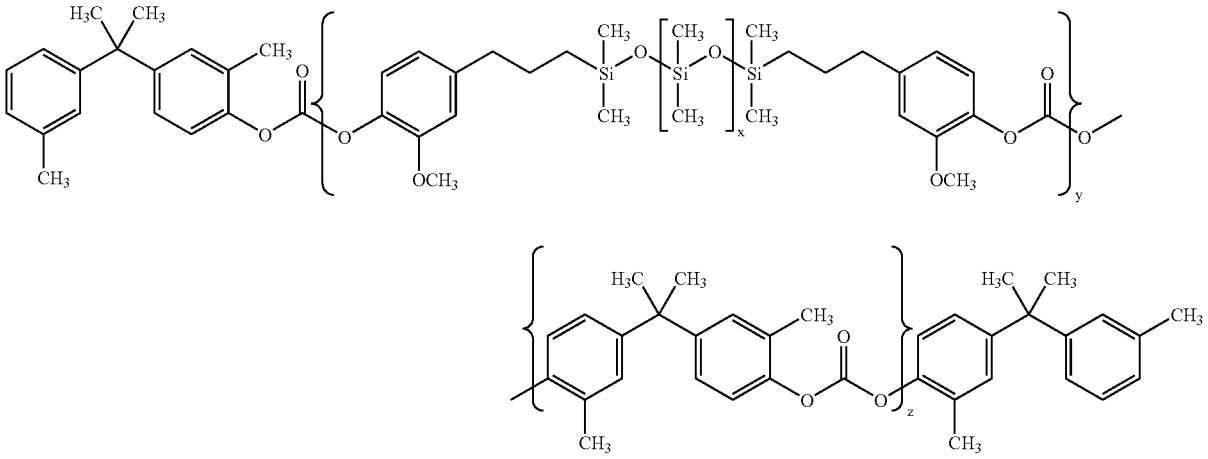

wherein x, y and z are integers representing the number of repeating units.

In yet another alternative embodiment, there is provided an electrophotographic imaging member comprising a flexible substrate with a conducting layer, at least one imaging layer with an overcoat positioned on a first side of the substrate; an optional ground strip layer on the at least one imaging layer; and an anticurl back coating positioned on a second side of the substrate opposite to the at least one imaging layer with the overcoat. This overcoat 42 of the present disclosure is formulated from yet another alternative low surface energy polycarbonate, modified from the modified bisphenol Z polycarbonate which is being formed by modifying the modified poly(4,4'-diphenyl-1,1'-cyclohexane carbonate) to contain a small fraction of polydimethyl siloxane in the polymer back bone. The molecular structure of this modified bisphenol Z polycarbonate for use in disclosure overcoat 42 formulation is provided below in Formula (IV):

Formula (IV)

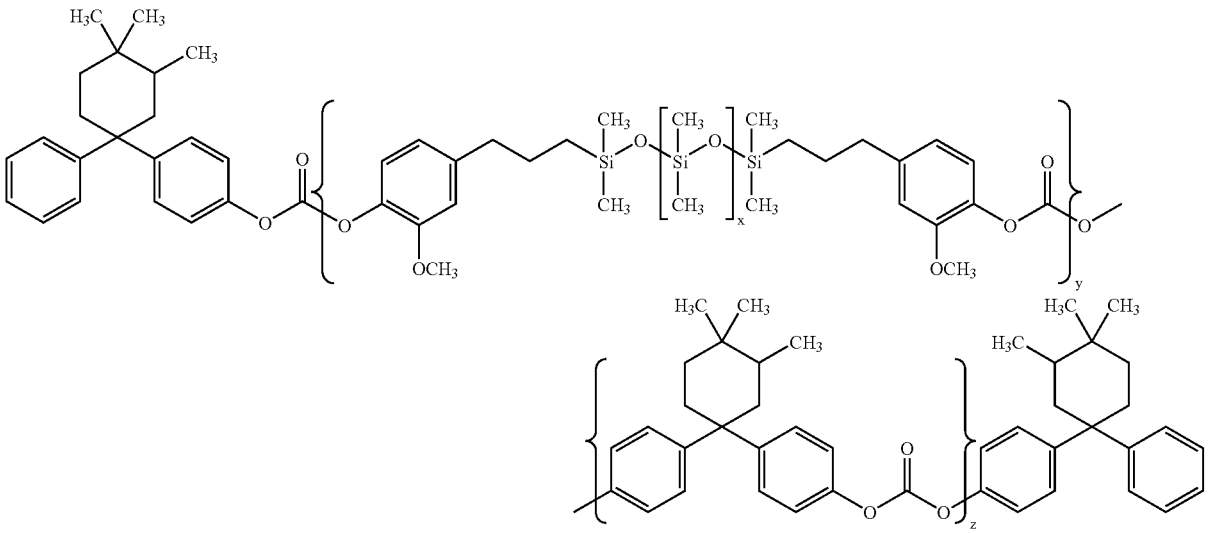

wherein x, y and z are integers representing the number of repeating units.

In still another embodiment, a process for making an improved electrophotographic imaging member is provided, comprising providing a flexible substrate with a conducting layer; forming at least one imaging layer with an overcoat on a first side of the substrate; forming an optional ground strip layer on the at least one imaging layer; and forming an anticurl back coating on a second side of the substrate opposite to the at least one imaging layer with an overcoat. Wherein both the overcoat of this disclosure on the at least one imaging layer and the anticurl back coating includes are created from a low surface energy polycarbonate which is modified from a specific polycarbonate formed to contain a small fraction of polydimethyl siloxane in the polymer back bone. The low surface energy polycarbonate suitable for the present disclosure overcoat formulation is being selected from the group consisting of bisphenol A, bisphenol Z, and bisphenol C. The anticurl back coating to be created with these polycarbonates may also include an optional adhesion promoter. If employed, the formulated low surface energy anticurl back coating may comprise, from about 0.2 to about 20 weight percent VITEL PE 2200 adhesive promoter based from the total weight of the anticurl back coating.

The polymer to be used in the art of present disclosure is a low surface energy polycarbonate derived/modified from a bisphenol A, a bisphenol C, or a bisphenol Z based polymer described by Formula (I), (II), (II), and (IV) in the preceding. Embodiments for the preparation of present disclosure overcoat layer, demonstrated by utilizing LEXAN EXL 1414-T bisphenol A polycarbonate-based polymer of Formula (I) as well as all the modified polycarbonate of Formulas (II), (III), and (IV), may use the polymer having a weight average molecular weight of from about 20,000 to 200,000. However, it is preferably to be between about for the ease of solution preparation using conventional organic solvents and thin overcoat layer formulation point of view, molecular weight between about 25,000 and about 150,000 is preferred. The viscosity a coating solution prepared from one of these low surface energy polymers can ranges from about 10 to about 900 centipoise (cp) when dissolved in a convenient solution, such as methylene chloride. Nonetheless, coating solution viscosity can also be easily adjusted at will to meet any coating process requirement by either changing the concentration of the polymer dissolved in the solution or by simply using another organic solvent.

In extended embodiments, copolymers obtained from Mitsubishi Gas Chemical Corporation (Tokyo, Japan), and referred to as FPC0540UA, $FPC_{0550}UA$, $FPC_{0580}UA$, and $FPC_{0170}UA$, may alternatively be used for low surface energy disclosure overcoat formulation, as disclosed in commonly assigned U.S. patent application Ser. No. 11/320,459, filed Dec. 27, 2005 entitled "Improved Imaging Member, which is herein incorporated by reference. Nevertheless, the PDMS-containing bisphenol polycarbonate used for overcoating creation, such as for example LEXAN EXL 1414-T, does give lowest surface energy and least surface contact friction than that of an overcoat counterpart prepared from these Mitsubishi polycarbonate.

The disclosure overcoat may comprise about 0 to about 10 percent by weight of a charge transport compound; but is preferably to comprise between about 1 and about 5 percent by weight charge transport compound based on the total weight of the overcoat. The overcoat is from about 1 to about 10 micrometers in thickness, and preferred to be between about 2 and about 6 micrometer-thick. The formulation of present disclosure overcoat is equally applicable as a protective overcoat for imaging members of rigid drum design.

Electrophotographic flexible imaging member belts are well known in the art. Typically, a flexible substrate is provided having an electrically conductive surface. For electrophotographic imaging members, at least one photoconductive layer is applied to the electrically conductive surface. A charge blocking layer may be applied to the electrically conductive layer prior to the application of the photoconductive layer. If desired, an adhesive layer may be utilized between the charge blocking layer and the photoconductive layer. For multilayered photoreceptors, a charge generation binder layer is usually applied onto an adhesive layer, if present, or directly over the blocking layer, and a CTL is subsequently formed on the charge generation layer. For ionographic imaging members used in an electrographic system, an electrically insulating dielectric imaging layer is applied to the electrically conductive surface. The substrate contains an anticurl back coating on the side opposite from the side bearing the electrically active layer.

For electrographic imaging members, a flexible dielectric layer overlying the conductive layer may be substituted for the active photoconductive layers. Any suitable, conventional, flexible, electrically insulating, thermoplastic dielectric polymer matrix material may be used in the dielectric layer of the electrographic imaging member. If desired, the flexible belts of this invention may be used for other purposes where cycling durability is important.

The process of this disclosure for fabricating the flexible electrophotographic imaging member webs described above and in the Examples below comprises providing a substrate layer having a first side and a second side, and at least a first parallel side and a second parallel side. The substrate may further include a conducting layer. The process includes forming at least one imaging layer on the first side of the substrate, forming an overcoat layer of the present disclosure over the at least one imaging layer, and then forming an anticurl back coating on the second side of the substrate to render the imaging member desired flatness. The formulated protective overcoat over the CTL, utilizing each of these low surface energy polycarbonates, gives superb surface lubricity to effect contact friction reduction, enhances scratch/abrasion resistance, and suppresses surface filming development. The anticurl back coating thus created does likewise reduce surface contact friction and eliminates electrostatic charges build-up problem as well.

Additionally, there may also be included steps and process for forming the disclosure overcoat layer on the at least one imaging layer, as well as for forming an optional ground strip layer on the at least one imaging layer.

The multilayered, flexible electrophotographic imaging member web stocks fabricated in accordance with the embodiments described herein may be cut into rectangular sheets. Each cut sheet is then brought overlapped at ends thereof and joined by any suitable means, such as ultrasonic welding, gluing, taping, stapling, or pressure and heat fusing to form a continuous imaging member seamed belt, sleeve, or cylinder.

The prepared flexible imaging belt thus prepared may thereafter be employed in any suitable and conventional electrophotographic imaging process which utilizes uniform charging prior to imagewise exposure to activating electromagnetic radiation. When the imaging surface of an electrophotographic member is uniformly charged with an electrostatic charge and imagewise exposed to activating electromagnetic radiation, conventional positive or reversal development techniques may be employed to form a marking material image on the imaging surface of the electrophotographic imaging member. Thus, by applying a suitable electrical bias and selecting toner having the appropriate polarity of electrical charge, a toner image is formed in the charged areas or discharged areas on the imaging surface of the electrophotographic imaging member. For example, for positive development, charged toner particles are attracted to the oppositely charged electrostatic areas of the imaging surface and for reversal development, charged toner particles are attracted to the discharged areas of the imaging surface.

The electrophotographic imaging member can be evaluated by printing in a marking engine into which a photoreceptor belt formed according to the exemplary embodiment has been installed. For the intrinsic electrical properties, it can also be investigated by conventional electrical drum scanners. Alternatively, the reduction in charge deficient spots can be evaluated using electrical techniques, such as those disclosed in U.S. Pat. Nos. 5,703,487; 5,697,024; 6,008,653; 6,119,536; 6,150,824 and 5,703,487, which are incorporated herein in their entireties by reference.

All the patents and applications referred to herein are hereby specifically, and totally incorporated herein by reference in their entirety in the instant specification.

EXAMPLES

The examples set forth hereinbelow are illustrative of different compositions and conditions that can be used in practicing the invention. All proportions are by weight unless otherwise indicated. It will be apparent, however, that the invention can be practiced with many types of compositions and can have many different uses in accordance with the disclosure above and as pointed out hereinafter.

Example 1

Control Imaging Member

A conventional prior art flexible electrophotographic imaging member web was prepared by providing a 0.02 micrometer thick titanium layer coated on a substrate of a biaxially oriented polyethylene naphthalate substrate (KADALEX, available from DuPont Teijin Films) having a thickness of 3.5 mils (89 micrometers). The titanized KADALEX substrate was extrusion coated with a blocking layer solution containing a mixture of 6.5 grams of gamma aminopropyltriethoxy silane, 39.4 grams of distilled water, 2.08 grams of acetic acid, 752.2 grams of 200 proof denatured alcohol and 200 grams of heptane. This wet coating layer was then allowed to dry for 5 minutes at 135° C. in a forced air oven to remove the solvents from the coating and form a crosslinked silane blocking layer. The resulting blocking layer had an average dry thickness of 0.04 micrometers as measured with an ellipsometer.

An adhesive interface layer was then extrusion coated by applying to the blocking layer a wet coating containing 5 percent by weight based on the total weight of the solution of polyester adhesive (MOR-ESTER 49,000, available from Morton International, Inc.) in a 70:30 (v/v) mixture of tetrahydrofuran/cyclohexanone. The resulting adhesive interface layer, after passing through an oven, had a dry thickness of 0.095 micrometers.

The adhesive interface layer was thereafter coated over with a charge generating layer. The charge generating layer dispersion was prepared by adding 1.5 gram of polystyrene-co-4-vinyl pyridine and 44.33 gm of toluene into a 4 ounce glass bottle. 1.5 grams of hydroxygallium phthalocyanine Type V and 300 grams of ⅛-inch (3.2 millimeters) diameter stainless steel shot were added to the solution. This mixture was then placed on a ball mill for about 8 to about 20 hours. The resulting slurry was thereafter coated onto the adhesive interface by extrusion application process to form a layer having a wet thickness of 0.25 mils. However, a strip of about 10 millimeters wide along one edge of the substrate web stock bearing the blocking layer and the adhesive layer was deliberately left uncoated by the charge generating layer to facilitate adequate electrical contact by a ground strip layer to be applied later. The wet charge generating layer was dried at 125° C. for 2 minutes in a forced air oven to form a dry charge generating layer having a thickness of 0.4 micrometers.

This coated web stock was simultaneously coated over with a CTL and a ground strip layer by co-extrusion of the coating materials. The CTL was prepared by combining MAKROLON 5705, a Bisphenol A polycarbonate thermoplastic having a molecular weight of about 120,000, commercially available from Farbensabricken Bayer A.G., with a charge transport compound N,N'-diphenyl-N,N'-bis(3-methylphenyl)-[1,1'-biphenyl]-4,4'-diamine in an amber glass bottle in a weight ratio of 1:1 (or 50 weight percent of each).

The resulting mixture was dissolved to give 15 percent by weight solid in methylene chloride. This solution was applied on the charge generating layer by extrusion to form a coating which upon drying in a forced air oven gave a CTL 29 micrometers thick.

The strip, about 10 millimeters wide, of the adhesive layer left uncoated by the charge generating layer, was coated with a ground strip layer during the co-extrusion process. The ground strip layer coating mixture was prepared by combining 23.81 grams of polycarbonate resin (MAKROLON 5705, 7.87 percent by total weight solids, available from Bayer A.G.), and 332 grams of methylene chloride in a carboy container. The container was covered tightly and placed on a roll mill for about 24 hours until the polycarbonate was dissolved in the methylene chloride. The resulting solution was mixed for 15-30 minutes with about 93.89 grams of graphite dispersion (12.3 percent by weight solids) of 9.41 parts by weight of graphite, 2.87 parts by weight of ethyl cellulose and 87.7 parts by weight of solvent (Acheson Graphite dispersion RW22790, available from Acheson Colloids Company) with the aid of a high shear blade dispersed in a water cooled, jacketed container to prevent the dispersion from overheating and losing solvent. The resulting dispersion was then filtered and the viscosity was adjusted with the aid of methylene chloride. This ground strip layer coating mixture was then applied, by co-extrusion with the CTL, to the electrophotographic imaging member web to form an electrically conductive ground strip layer having a dried thickness of about 19 micrometers.

The imaging member web stock containing all of the above layers was then passed through 125° C. in a forced air oven for 3 minutes to simultaneously dry both the CTL and the ground strip. At this point, the imaging member, having a 29-micrometer thick dried CTL, spontaneously exhibited upward curling into a 1.5-inch tube when unrestrained.

An anti-curl coating was prepared by combining 88.2 grams of polycarbonate resin (MAKROLON 5705), 7.12 grams VITEL PE-2200 copolyester (available from Bostik, Inc. Middleton, Mass.) and 1,071 grams of methylene chloride in a carboy container to form a coating solution containing 8.9 percent solids. The container was covered tightly and placed on a roll mill for about 24 hours until the polycarbonate and polyester were dissolved in the methylene chloride to form the anti-curl back coating solution. The anti-curl back coating solution was then applied to the rear surface (side opposite the charge generating layer and CTL) of the electrophotographic imaging member web by extrusion coating and dried to a maximum temperature of 125° C. in a forced air oven for 3 minutes to produce a dried anti-curl backing layer having a thickness of 17 micrometers and flatten the imaging member. The resulting imaging member was then used to served as a control.

Example II

Coating Layers Preparation

To prepared a free standing CTL, a coating solution was prepared by combining MAKROLON 5705 (a Bisphenol A polycarbonate thermoplastic having a molecular weight of about 120,000, commercially available from Farbensabricken Bayer A.G.) with a charge transport compound N,N'-diphenyl-N,N'-bis(3-methylphenyl)-[1,1'-biphenyl]-4,4'-diamine in an amber glass bottle in a weight ratio of 1:1 (or 50 weight percent of each). This mixture was dissolved in methylene chloride to give 15 weight percent of solid in the coating solution. This solution was applied onto a surface release substrate by hand coating technique using a 4.5 mil-gap bar, and then dried at 120° C. for 2 minutes in an air circulating oven to yield a 29-micrometer thick free standing CTL. The obtained CTL, having the standard material composition, is then used to serve as a reference sample for mechanical characteristic comparison.

In similar manners, a free standing low surface energy polycarbonate coating layer was also prepared. A coating solution was formulated by dissolving low surface energy GE LEXAN 1414-T polycarbonate with small amount of charge transport compound N,N'-diphenyl-N,N'-bis(3-methylphenyl)-[1,1'-biphenyl]-4,4'-diamine in methylene chloride. The low surface energy polycarbonate GE LEXAN EXL 1414-T has a weight average molecular weight of about 25,000. It is a commercial product available from GE Plastics Canada, Ltd (Mississauga, ONTL5N 5P2) and with the molecular structure described in Formula (I) below:

Formula (I)

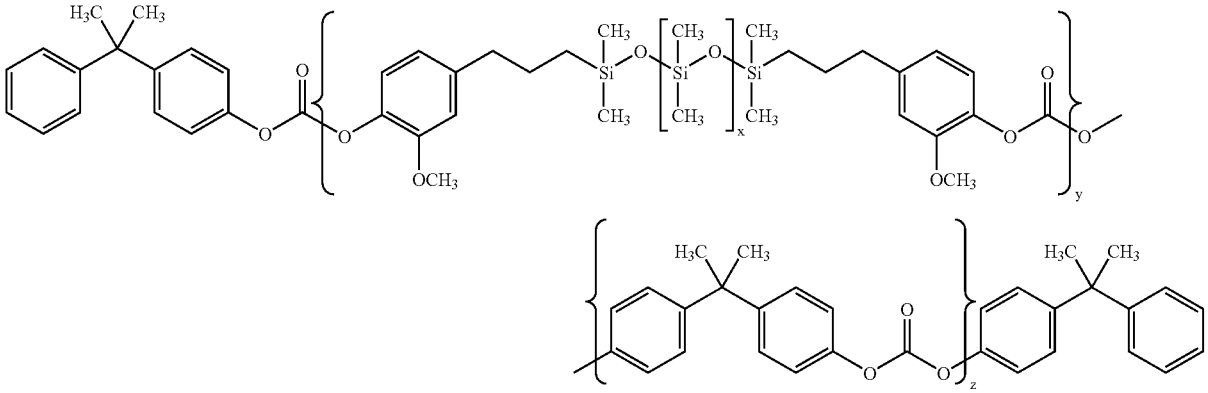

where x, y and z are integers representing the number of repeating units.

The prepared coating solution was hand coated and dried at elevated temperature by following the exact same procedures as described above to give a resulting free standing coating layer, comprising about 3 weight percent charge transport compound in and 97 weight percent of polymer, to represent an overcoat of the present disclosure.

Both the CTL and the low surface energy coating layer were determined for each respective mechanical properties using an Instron mechanical testing machine. The values of Young's modulus and the percent elongation at break obtained for the low surface energy coating were $3.1\times10^5$ psi and 102 percent as compared to $3.3\times10^5$ psi and 3.25 percent for the CTL. These mechanical properties indicate that the low surface energy coating layer prepared to contain only 3 weight percent charge transport compound, if to be used as disclosure protective overcoat, is a much more tougher layer to develop material failure than the standard CTL counterpart comprised of 50 weight percent same charge transport compound in the Makrolon matrix.

Example III

Disclosure Imaging Member

A flexible electrophotographic imaging member web was prepared by following the procedures and using the exact same materials as those described in Example I, but with the exception that the fabricated imaging member did include a 3-micrometer thick overcoat of the present disclosure. The overcoat was formulated with the low surface energy GE LEXAN EXL 1414-T polycarbonate and contained about 3 weight percent charge transport compound N,N'-diphenyl-N,N'-bis(3-methylphenyl)-[1,1'-biphenyl]-4,4'-diamine loading; it was applied directly over the CTL to give a resulting disclosure imaging member same as that illustrated in FIG. 1.

Mechanical and Photo-Electrical Evaluations

The prepared control imaging member of Example I and the disclosure imaging member having a protective overcoat of Example III were assessed for each respective physical and mechanical properties such as surface energy, coefficient of friction, scratch resistance, and 180° tape peel-off strength.

Surface energy was determined by liquid contact angle method, while the coefficient of friction was evaluated by sliding a stainless plate against the imaging member surface, and the 180° tape peel strength was carried out by placing a 3M masking tape over the surface and then 180° peeling the tape off for abhesiveness assessment. For surface scratch resistance determination, the two imaging members were investigated by utilizing a stylus surface scratching test method. In brief, each imaging member was laid down (with the top surface facing upwardly) on a flat platform, a stainless steel phonographic needle under a control 6-gram load was then sliding over the member surface at a constant speed of 4 inches/min. to induce a surface scratch. Both tested P/R imaging members were analyzed by TEM cross-sectioning to assess each respective scratch induced surface damage.

The experimental data collected and summarized in Table 1 below indicate that the imaging member prepared to include a low surface energy LEXAN EXL 1414-T polycarbonate overcoat of present disclosure did provide the benefits of surface lubricity, effective abrasion/scratch resistance enhancement, and surface abhesviness (as demonstrated by low 3M tape peel-off strength) to thereby ease of surface film removal by the cleaning or spot blade. Very importantly, the overcoat surface adhesiveness should also improve toner image transfer efficiency from the imaging member to a receiving paper. Furthermore, Since the LEXAN EXL 1414T polycarbonate is molecularly nearly identical to the Makrolon binder of the CTL, the applied overcoat was virtually fused onto the top of the CTL to form an inseparable bond.

TABLE 1

| MEMBER ID | SURFACE ENERGY | COEFFICIENT OF FRICTION | 180° PEEL STRENGTH | SCRATCH DEPTH |
|---|---|---|---|---|
| Control | 37 dynes/cm | 0.49 | 225 gms/cm | 0.68 micron |
| Disclosure | 21 dynes/cm | 0.31 | 37 gms/cm | 0.36 micron |

Figure 3:
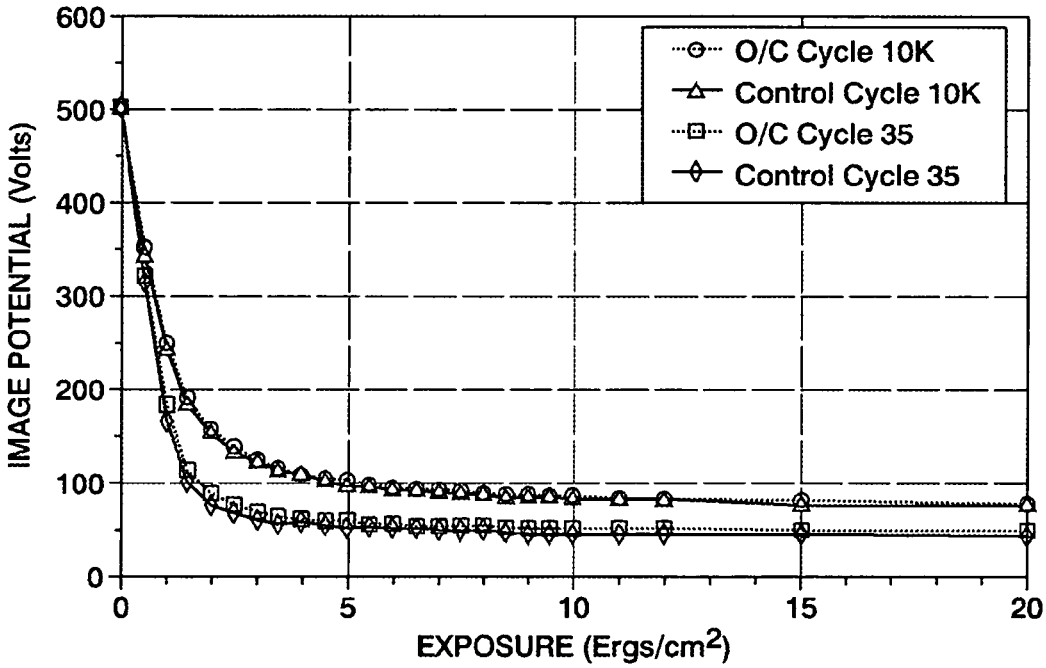
FIG. 3 is a graph illustrating the photo-electrical properties and the corresponding photo-induced discharge characteristic (PIDC) cyclic stability obtained for both a control and disclosure imaging member according to another embodiment of the present disclosure.

The control imaging member and the disclosure imaging member were further evaluated for each respective photo-electrical properties using a lab. scanner. The results thus obtained show that addition to the electrophotographic imaging member with a 3-micron thick low surface energy EXL 1414-T polycarbonate overcoat did not cause deleterious photo-electrical impact to the disclosure imaging member as compared to those properties of the control imaging member counterpart. The photo-electrical properties and the corresponding PIDC cyclic stability obtained for both the control and the disclosure imaging members are respectively listed in Table 2 and shown FIG. 3 below:

TABLE 2

| MEMBER ID | OVER-COAT | Vbg 3.5 ergs/cm$^2$ 34 cycles | Vbg 3.5 ergs/cm$^2$ 10k cycles | Dark Decay | Vr 300 ergs/cm$^2$ |
|---|---|---|---|---|---|
| CONTROL | None | 57 | 114 | −168 | 25 |
| DISCLOSURE | EXL1414-T | 64 | 117 | −138 | 27 |

In recapitulation, the embodiments described and demonstrated in the preceding had established solid proof to show that imaging member prepared to include a low surface energy LEXAN EXL 1414-T polycarbonate overcoat of present disclosure not only could provide superb physical and mechanical improvements over those of the control imagine member counterpart, it did also maintain the crucially important photo-electrical integrity of the disclosure imaging member as well.

It will be appreciated that various of the above-disclosed and other features and functions, or alternatives thereof, may be desirably combined into many other different systems or applications. Various presently unforeseen or unanticipated alternatives, modifications, variations or improvements therein may be subsequently made by those skilled in the art which are also intended to be encompassed by the following claims.

What is claimed is:

1. An electrophotographic imaging member comprising:

a substrate;

a charge generating layer disposed on the substrate;

at least one charge transport layer disposed on the charge generating layer; and an overcoat layer disposed on the charge transport layer, the overcoat layer further comprising a low surface energy modified polycarbonate polymer, the polymer being selected from the group consisting of a modified Bisphenol A polycarbonate of poly(4,4'-isopropylidene diphenyl carbonate) having polydimethyl siloxane present in the polymer back bone in an amount of from about 2% to about 10% by weight of the total weight of the polymer and having the following formula (I):

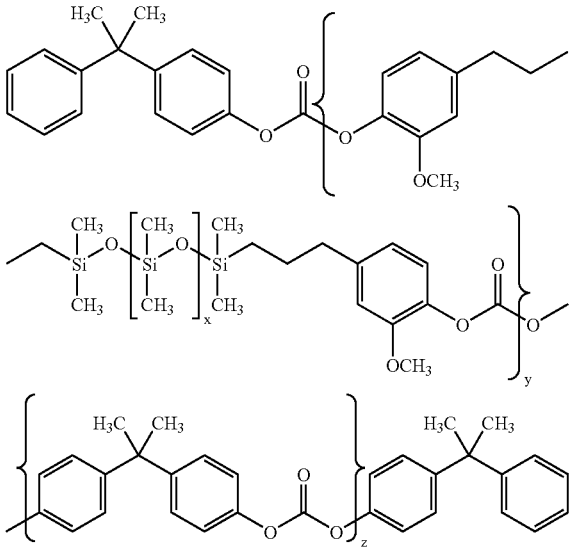

wherein x is an integer representing a number of repeating units of the polydimethyl siloxane present in an amount of from about 2% to about 10% by weight of the total weight of the polymer and, y and z are integers representing a number of repeating units, a modified Bisphenol Z polycarbonate of poly(4,4'-diphenyl-1,1'-cyclohexane carbonate) having polydimethyl siloxane present in the polymer back bone in an amount of from about 2% to about 10% by weight of the total weight of the polymer and having the following formula (II):

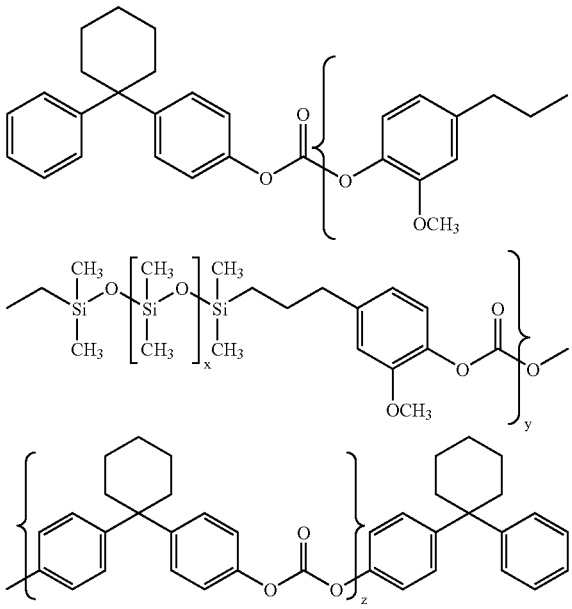

wherein x is an integer representing a number of repeating units of the polydimethyl siloxane present in an amount of from about 2% to about 10% by weight of the total weight of the polymer and, y and z are integers representing a number of repeating units, a modified Bisphenol C polycarbonate of poly(4,4'-isopropylidene diphenyl carbonate) having polydimethyl siloxane present in the polymer back bone in an amount of from about 2% to about 10% by weight of the total weight of the polymer and having the following formula (III):

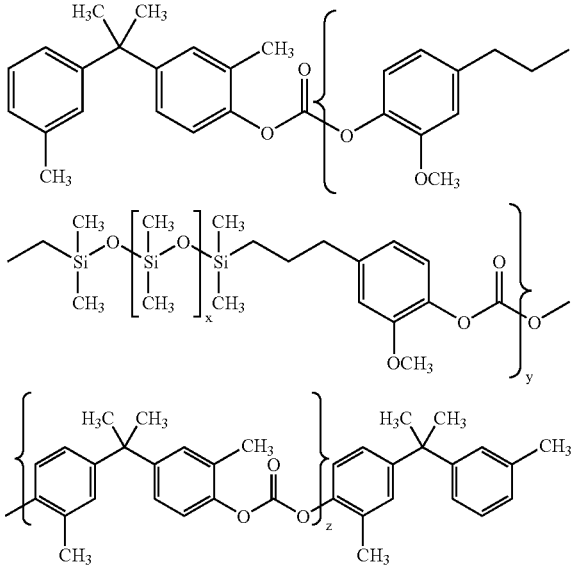

wherein x is an integer representing a number of repeating units of the polydimethyl siloxane present in an amount of from about 2% to about 10% by weight of the total weight of the polymer and, y and z are integers representing a number of repeating units, a modified Bisphenol Z polycarbonate of poly(4,4'-diphenyl-1,1'-cyclohexane carbonate) having polydimethyl siloxane present in the polymer back bone in an amount of from about 2% to about 10% by weight of the total weight of the polymer and having the following formula (IV):

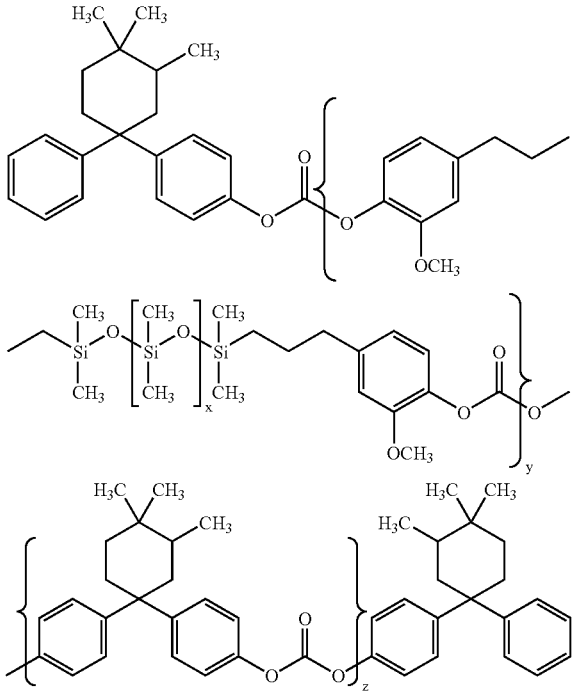

wherein x is an integer representing a number of repeating units of the polydimethyl siloxane present in an amount of from about 2% to about 10% by weight of the total weight of the polymer and, y and z are integers representing a number of repeating units, and mixtures thereof.

2. The electrophotographic imaging member of claim 1 further including an anticurl back coating layer, the anticurl back coating layer comprising a low surface energy modified polycarbonate polymer, the polymer being selected from the group consisting of a modified Bisphenol A polycarbonate of poly(4,4'-isopropylidene diphenyl carbonate) having polydimethyl siloxane present in the polymer back bone in an amount of from about 2% to about 10% by weight of the total weight of the polymer and having the following formula (I):

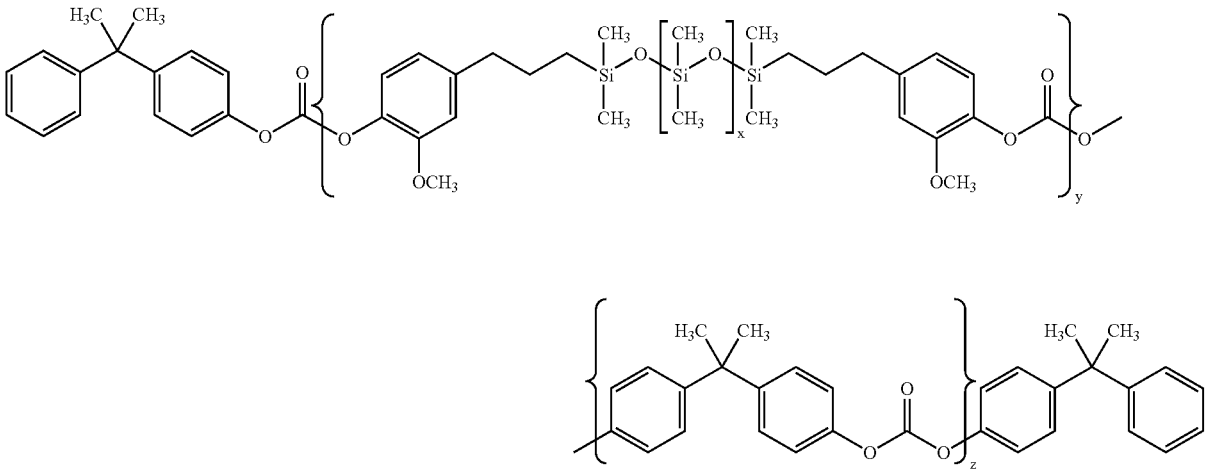

wherein x is an integer representing a number of repeating units of the polydimethyl siloxane present in an amount of from about 2% to about 10% by weight of the total weight of the polymer and, y and z are integers representing a number of repeating units, a modified Bisphenol Z polycarbonate of poly(4,4'-diphenyl-1,1'-cyclohexane carbonate) having polydimethyl siloxane present in the polymer back bone in an amount of from about 2% to about 10% by weight of the total weight of the polymer and having the following formula (II):

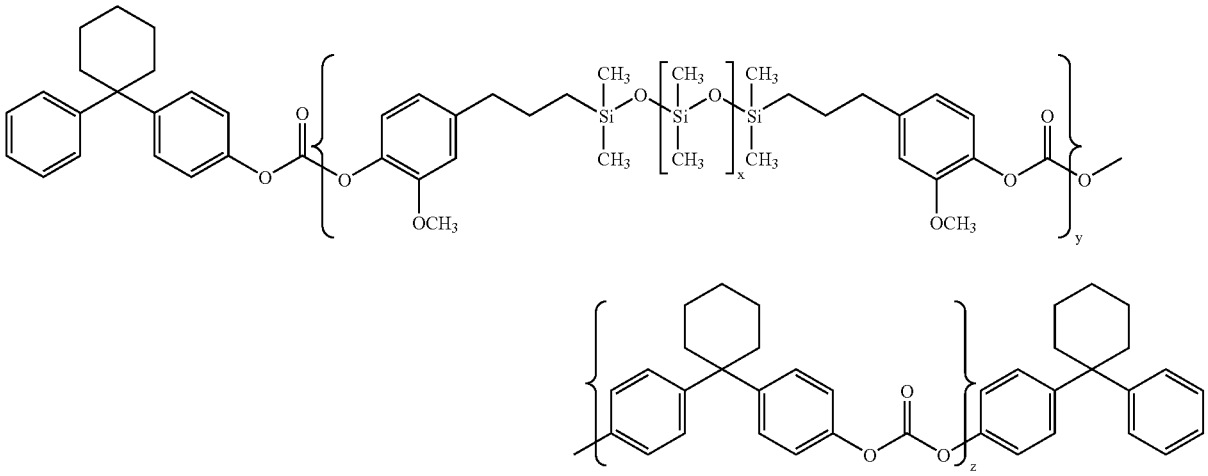

wherein x is an integer representing a number of repeating units of the polydimethyl siloxane present in an amount of from about 2% to about 10% by weight of the total weight of the polymer and, y and z are integers representing a number of repeating units, a modified Bisphenol C polycarbonate of poly(4,4'-isopropylidene diphenyl carbonate) having polydimethyl siloxane present in the polymer back bone in an amount of from about 2% to about 10% by weight of the total weight of the polymer and having the following formula (III):

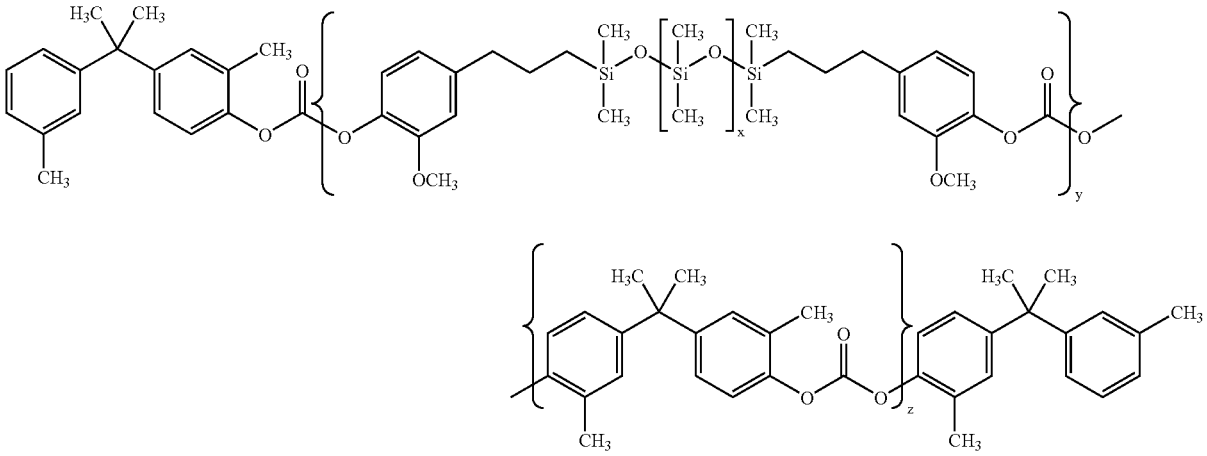

wherein x is an integer representing a number of repeating units of the polydimethyl siloxane present in an amount of from about 2% to about 10% by weight of the total weight of the polymer and, y and z are integers representing a number of repeating units, a modified Bisphenol Z polycarbonate of poly(4,4'-diphenyl-1,1'-cyclohexane carbonate) having polydimethyl siloxane present in the polymer back bone in an amount of from about 2% to about 10% by weight of the total weight of the polymer and having the following formula (IV):

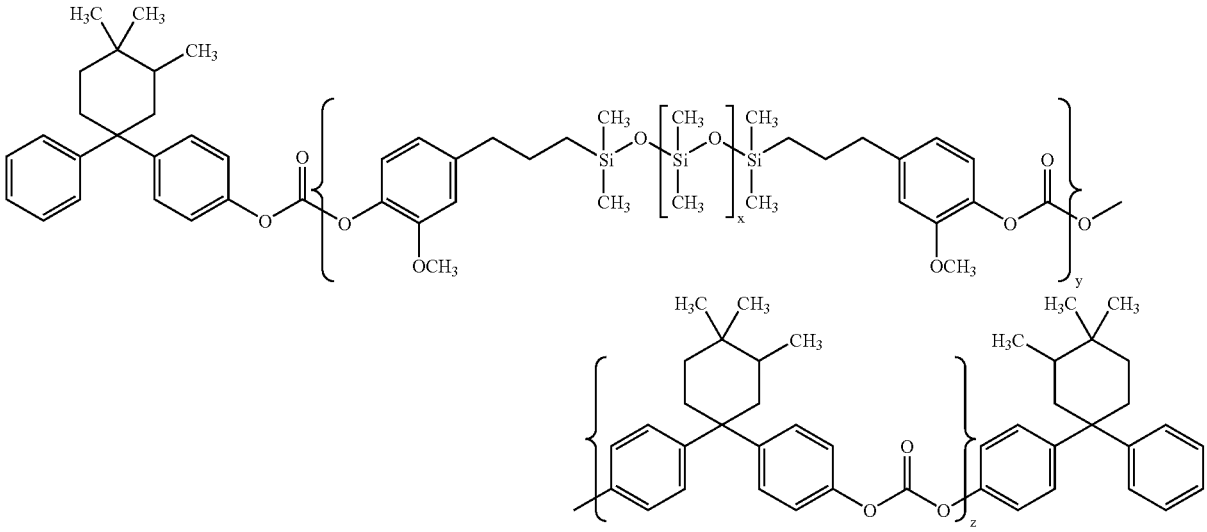

wherein x is an integer representing a number of repeating units of the polydimethyl siloxane present in an amount of from about 2% to about 10% by weight of the total weight of the polymer and, y and z are integers representing a number of repeating units, and mixtures thereof.

3. The electrophotographic imaging member of claim 2, wherein the anticurl back coating includes an adhesion promoter of from about 0.2 percent to about 20 percent, or from about 2 percent to about 10 percent by weight, based on the total weight of the anticurl back coating.

4. The electrophotographic imaging member of claim 3, wherein the adhesion promoter is selected from the group consisting of a copolyester and VITEL PE2200.

5. The electrophotographic imaging member of claim 1, wherein the polymer has a molecular weight of from about 20,000 to about 200,000.

6. The electrophotographic imaging member of claim 5, wherein the polymer has a molecular weight of from about 25,000 to about 150,000.

7. The electrophotographic imaging member of claim 2, wherein the polydimethyl siloxane is present in an amount of from about 2 percent to about 8 percent by weight of the total weight of the polymer.

8. The electrophotographic imaging member of claim 1, wherein the overcoat layer has a thickness of from about 1 micrometer to about 10 micrometers.

9. The electrophotographic imaging member of claim 8, wherein the overcoat layer has a thickness of from about 2 micrometers to about 6 micrometers.

10. An electrophotographic imaging member comprising:

a substrate;

a charge generating layer disposed on the substrate;

at least one charge transport layer disposed on the charge generating layer;

an overcoat layer disposed on the charge transport layer, the overcoat layer comprising a low surface energy modified polycarbonate polymer, the polymer being selected from the group consisting of a modified Bisphenol A polycarbonate of poly(4,4'-isopropylidene diphenyl carbonate) having polydimethyl siloxane present in the polymer back bone in an amount of from about 2% to about 10% by weight of the total weight of the polymer and having the following formula (I):

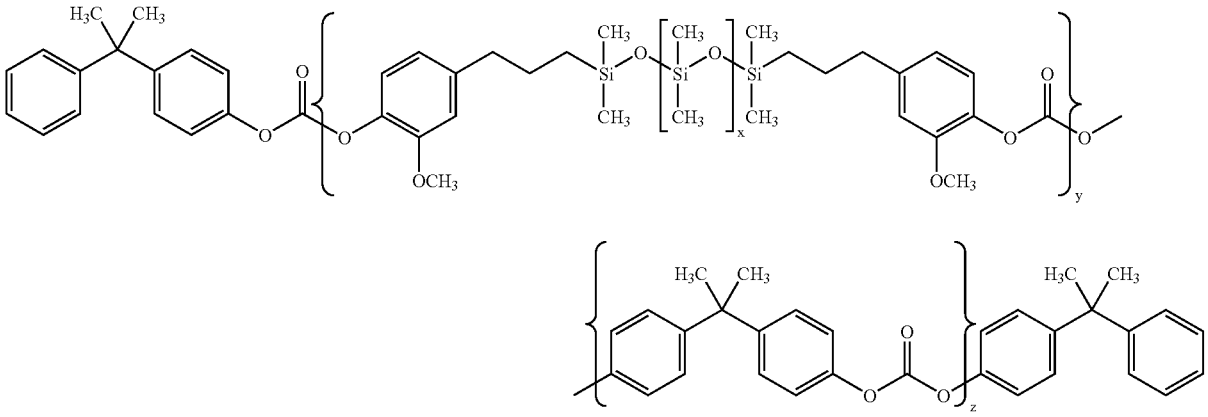

wherein x is an integer representing a number of repeating units of the polydimethyl siloxane present in an amount of from about 2% to about 10% by weight of the total weight of the polymer and, y and z are integers representing a number of repeating units, a modified Bisphenol Z polycarbonate of poly(4,4'-diphenyl-1,1'-cyclohexane carbonate) having polydimethyl siloxane present in the polymer back bone in an amount of from about 2% to about 10% by weight of the total weight of the polymer and having the following formula (II):

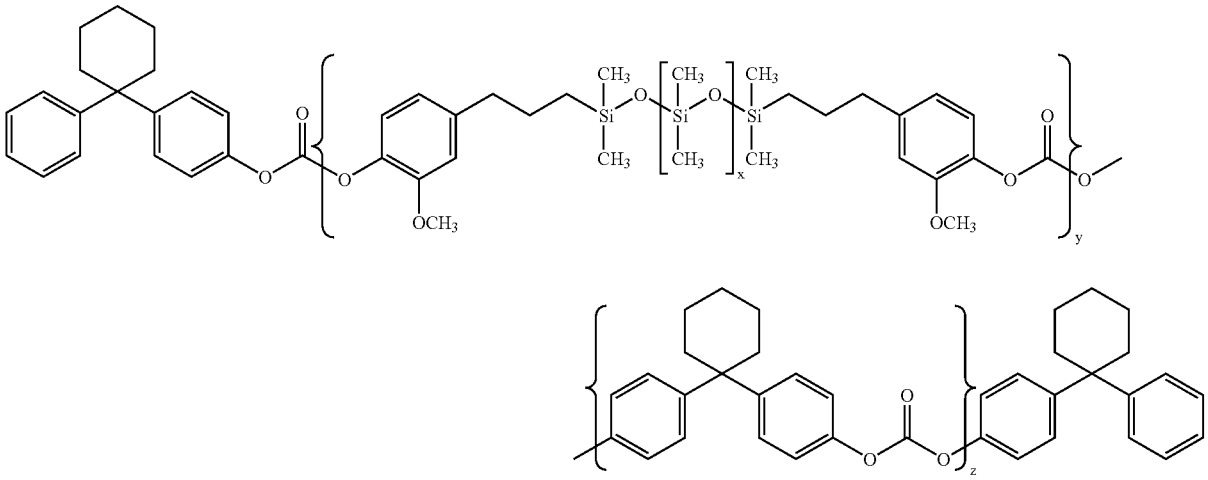

wherein x is an integer representing a number of repeating units of the polydimethyl siloxane present in an amount of from about 2% to about 10% by weight of the total weight of the polymer and, y and z are integers representing a number of repeating units, a modified Bisphenol C polycarbonate of poly(4,4'-isopropylidene diphenyl carbonate) having polydimethyl siloxane present in the polymer back bone in an amount of from about 2% to about 10% by weight of the total weight of the polymer and having the following formula (III):

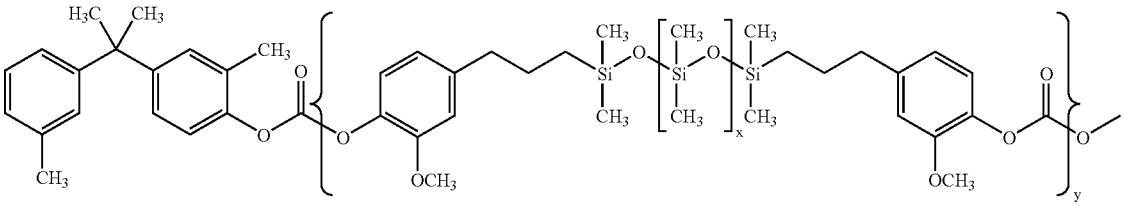

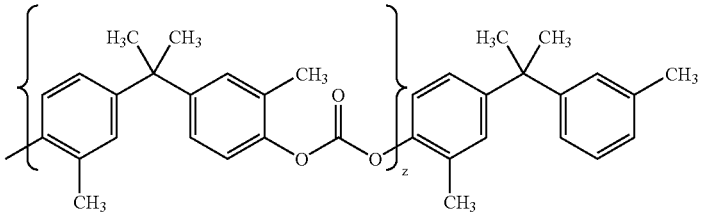

30 wherein x is an integer representing a number of repeating units of the polydimethyl siloxane present in an amount of from about 2% to about 10% by weight of the total weight of the polymer and, y and z are integers representing a number of repeating units, a modified Bisphenol Z polycarbonate of poly(4,4'-diphenyl-1,1'-cyclohexane carbonate) having polydimethyl siloxane present in the polymer back bone in an amount of from about 2% to about 10% by weight of the total weight of the polymer and having the following formula (IV):

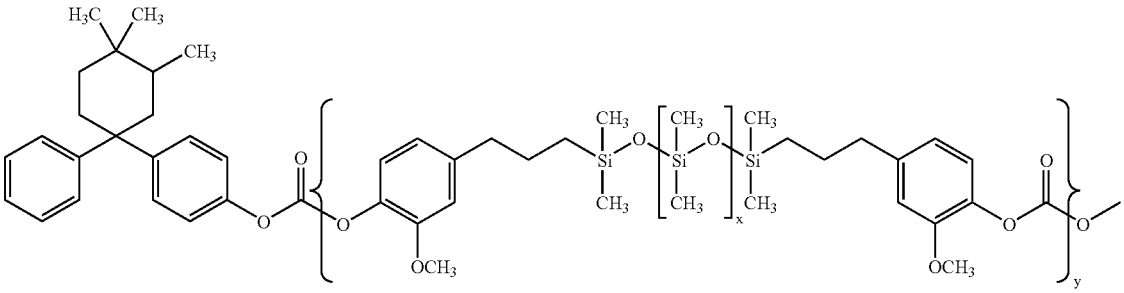

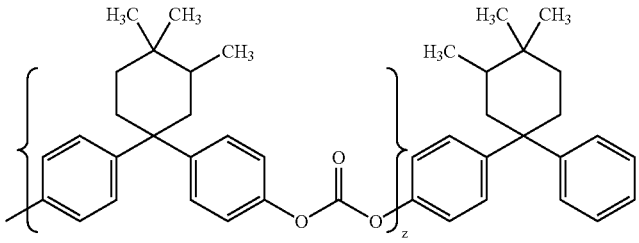

wherein x is an integer representing a number of repeating units of the polydimethyl siloxane present in an amount of from about 2% to about 10% by weight of the total weight of the polymer and, y and z are integers representing a number of repeating units, and mixtures thereof; and an anticurl back coating layer, the anticurl back coating layer comprising a low surface energy modified polycarbonate polymer, the polymer being selected from the group consisting of a modified Bisphenol A polycarbonate of poly(4,4'-isopropylidene diphenyl carbonate) having polydimethyl siloxane present in the polymer back bone in an amount of from about 2% to about 10% by weight of the total weight of the polymer and having the following formula (I):

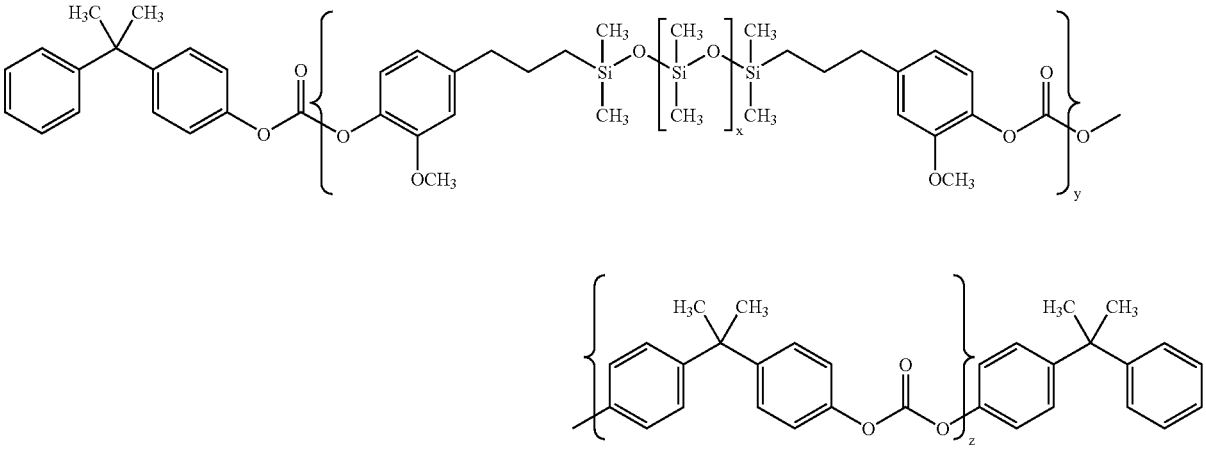

wherein x is an integer representing a number of repeating units of the polydimethyl siloxane present in an amount of from about 2% to about 10% by weight of the total weight of the polymer and, y and z are integers representing a number of repeating units, a modified Bisphenol Z polycarbonate of poly(4,4'-diphenyl-1,1'-cyclohexane carbonate) having polydimethyl siloxane present in the polymer back bone in an amount of from about 2% to about 10% by weight of the total weight of the polymer and having the following formula (II):

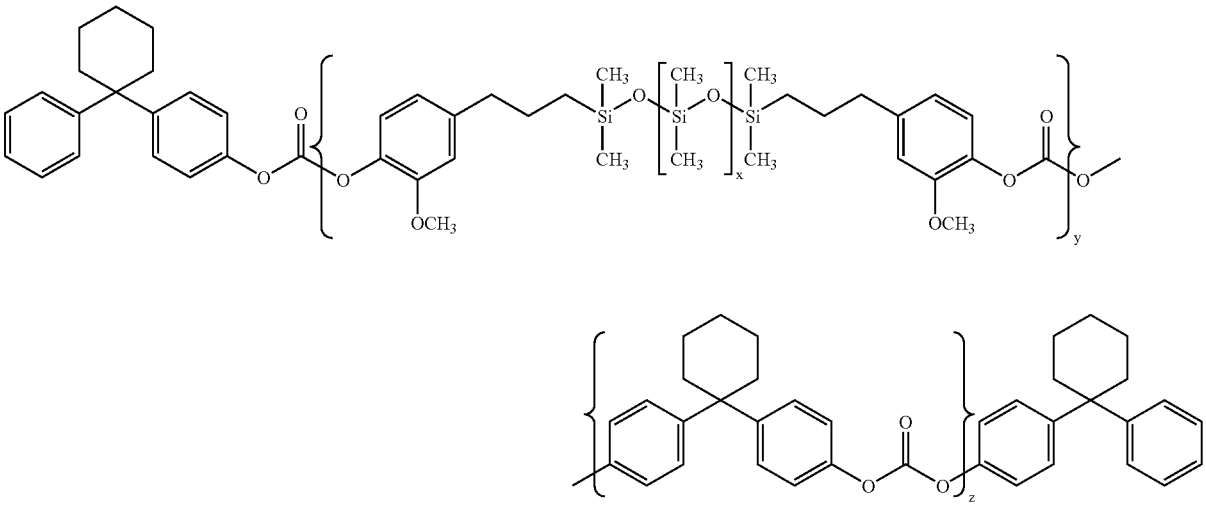

wherein x is an integer representing a number of repeating units of the polydimethyl siloxane present in an amount of from about 2% to about 10% by weight of the total weight of the polymer and, y and z are integers representing a number of repeating units, a modified Bisphenol C polycarbonate of poly(4,4'-isopropylidene diphenyl carbonate) having polydimethyl siloxane present in the polymer back bone in an amount of from about 2% to about 10% by weight of the total weight of the polymer and having the following formula (III):

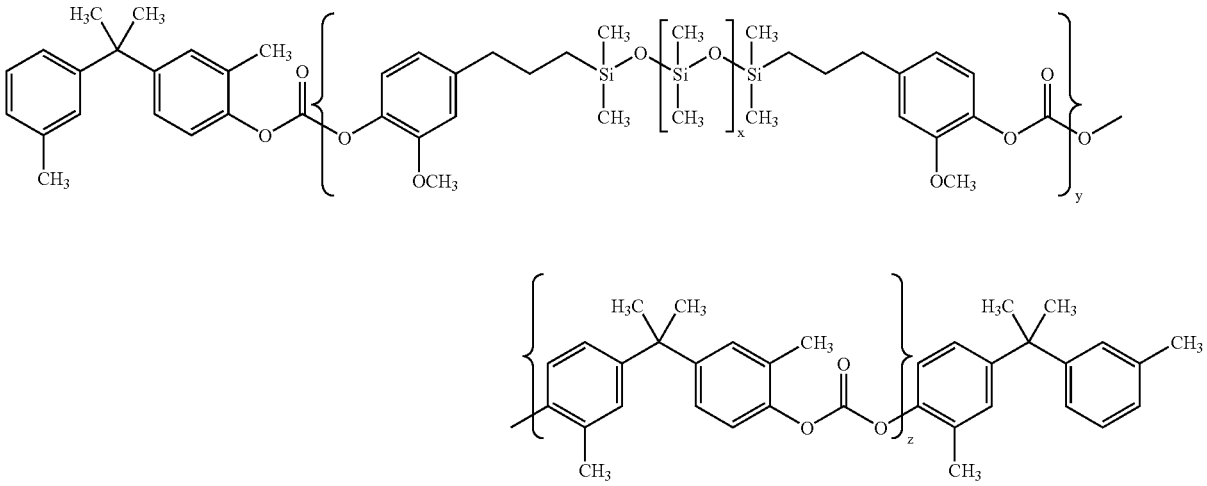

wherein x is an integer representing a number of repeating units of the polydimethyl siloxane present in an amount of from about 2% to about 10% by weight of the total weight of the polymer and, y and z are integers representing a number of repeating units, a Bisphenol Z polycarbonate of poly(4,4'-diphenyl-1,1'-cyclohexane carbonate) having polydimethyl siloxane present in the polymer back bone in an amount of from about 2% to about 10% by weight of the total weight of the polymer and having the following formula (IV):

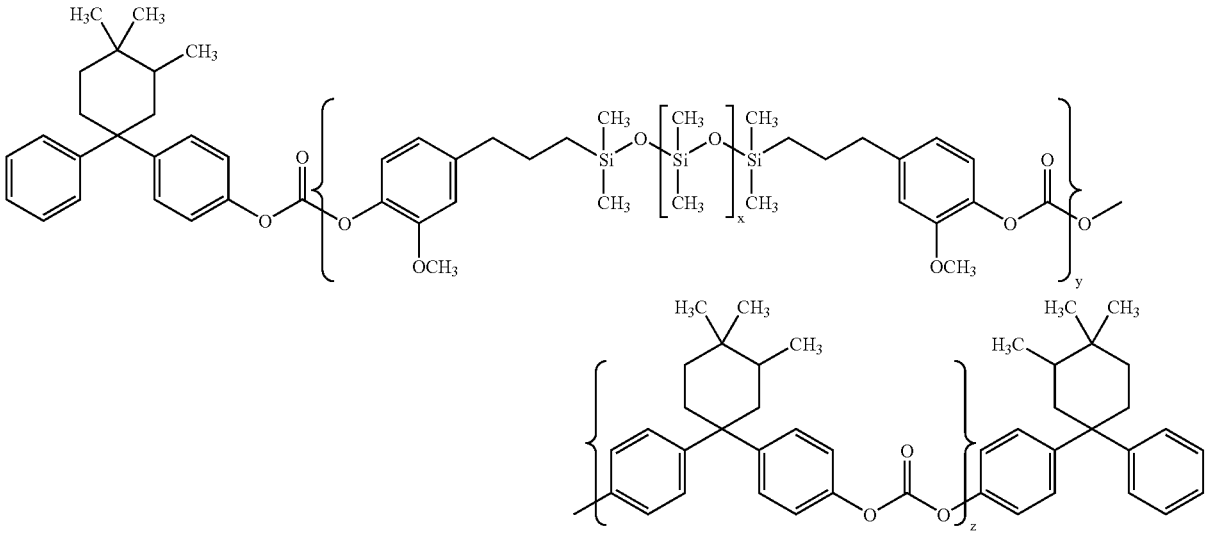

wherein x is an integer representing a number of repeating units of the polydimethyl siloxane present in an amount of from about 2% to about 10% by weight of the total weight of the polymer and, y and z are integers representing a number of repeating units, and mixtures thereof.

11. An image forming apparatus for forming images on a recording medium comprising:

an imaging member having a charge retentive surface for receiving an electrostatic latent image thereon, wherein the imaging member comprises a substrate, a charge generating layer disposed on the substrate, at least one charge transport layer disposed on the charge generating layer, and an overcoat layer disposed on the charge transport layer, the overcoat layer comprising a low surface energy modified polycarbonate polymer, the polymer being selected from the group consisting of modified Bisphenol A polycarbonate of poly(4,4'-isopropylidene diphenyl carbonate) having polydimethyl siloxane present in the polymer back bone in an amount of from about 2% to about 10% by weight of the total weight of the polymer and having the following formula (I):

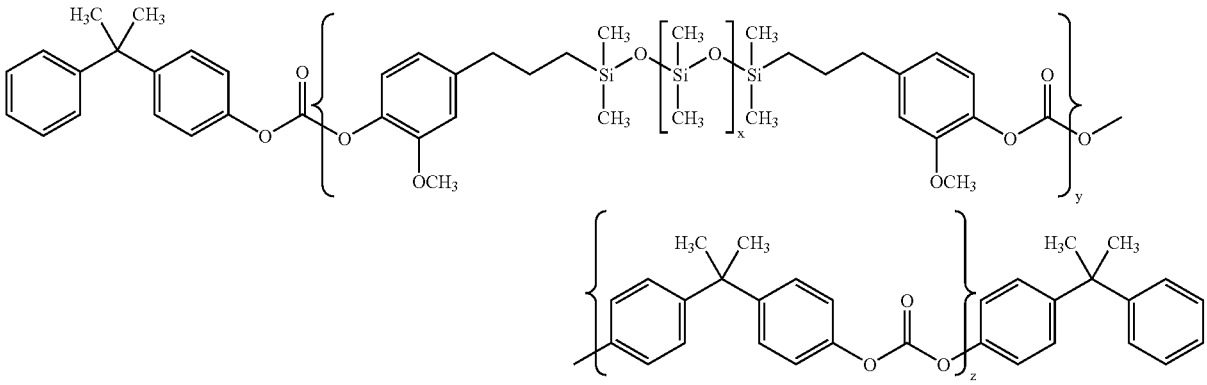

wherein x is an integer representing a number of repeating units of the polydimethyl siloxane present in an amount of from about 2% to about 10% by weight of the total weight of the polymer and, y and z are integers representing a number of repeating units, a modified Bisphenol Z polycarbonate of poly(4,4'-diphenyl-1,1'-cyclohexane carbonate) having polydimethyl siloxane present in the polymer back bone in an amount of from about 2% to about 10% by weight of the total weight of the polymer and having the following formula (II):

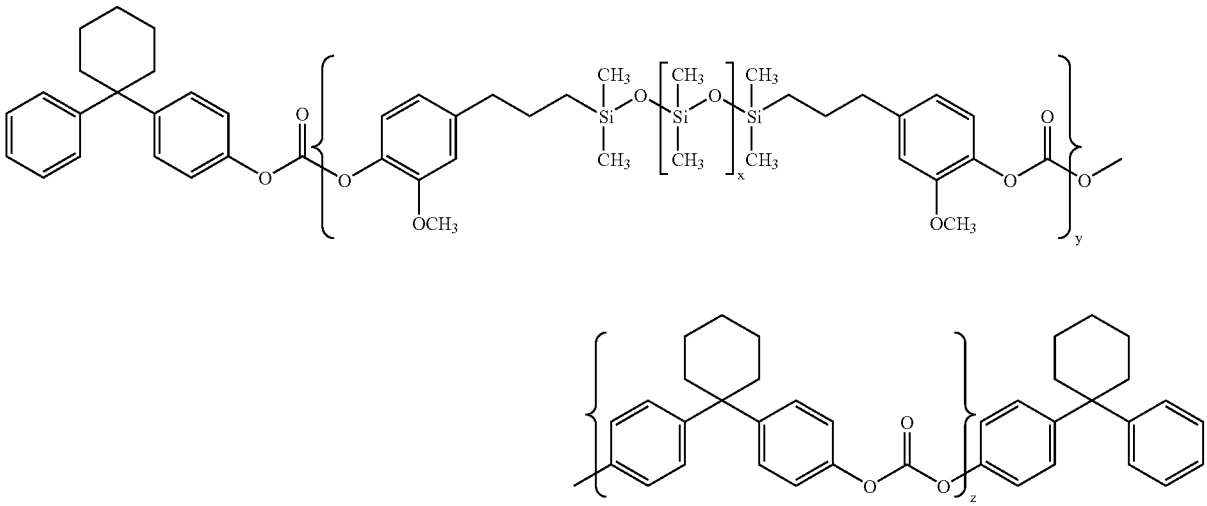

wherein x is an integer representing a number of repeating units of the polydimethyl siloxane present in an amount of from about 2% to about 10% by weight of the total weight of the polymer and, y and z are integers representing a number of repeating units, a modified Bisphenol C polycarbonate of poly(4,4'-isopropylidene diphenyl carbonate) having polydimethyl siloxane present in the polymer back bone in an amount of from about 2% to about 10% by weight of the total weight of the polymer and having the following formula (III):

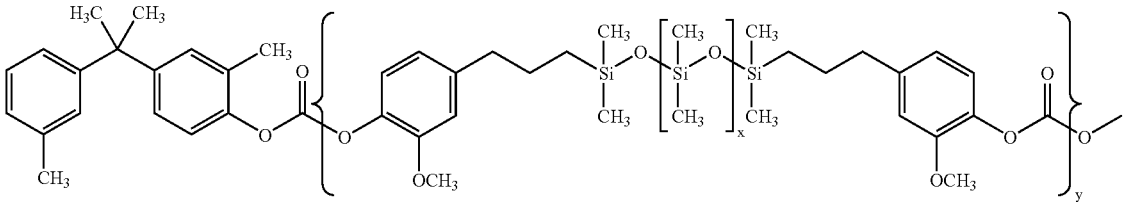

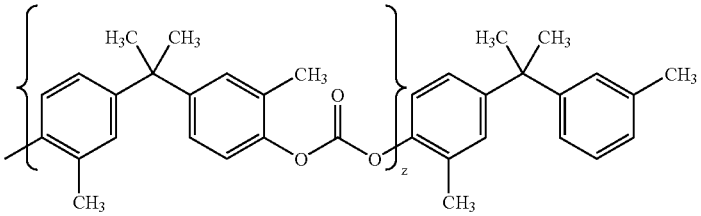

wherein x is an integer representing a number of repeating units of the polydimethyl siloxane present in an amount of from about 2% to about 10% by weight of the total weight of the polymer and, y and z are integers representing a number of repeating units, a modified Bisphenol Z polycarbonate of poly(4,4'-diphenyl-1,1'-cyclohexane carbonate) having polydimethyl siloxane present in the polymer back bone in an amount of from about 2% to about 10% by weight of the total weight of the polymer and having the following formula (IV):

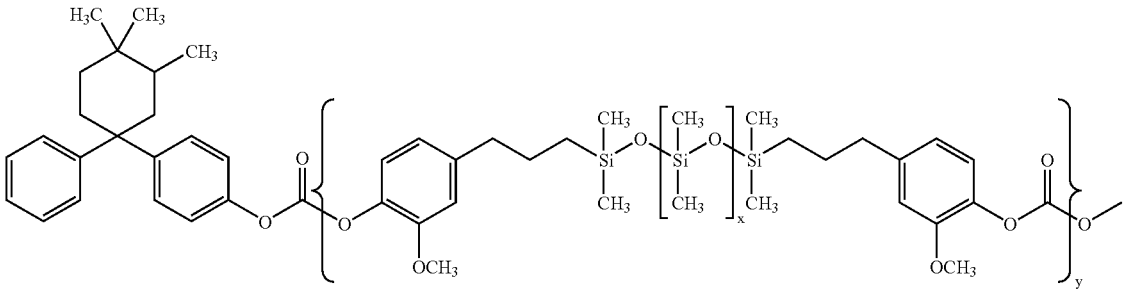

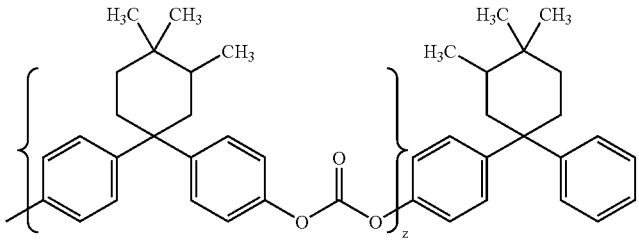

wherein x is an integer representing a number of repeating units of the polydimethyl siloxane present in an amount of from about 2% to about 10% by weight of the total weight of the polymer and, y and z are integers representing a number of repeating units, and mixtures thereof;

a development component for applying a developer material to the charge-retentive surface;

a transfer component for applying the developed image from the charge-retentive surface to a copy substrate; and a fusing component for fusing the developed image to the copy substrate.

12. The image forming apparatus of claim 11 further including an anticurl back coating layer, the anticurl back coating layer comprising a low surface energy modified polycarbonate polymer, the polymer being selected from the group consisting of a modified Bisphenol A polycarbonate of poly(4,4'-isopropylidene diphenyl carbonate) having polydimethyl siloxane present in the polymer back bone in an amount of from about 2% to about 10% by weight of the total weight of the polymer and having the following formula (I):

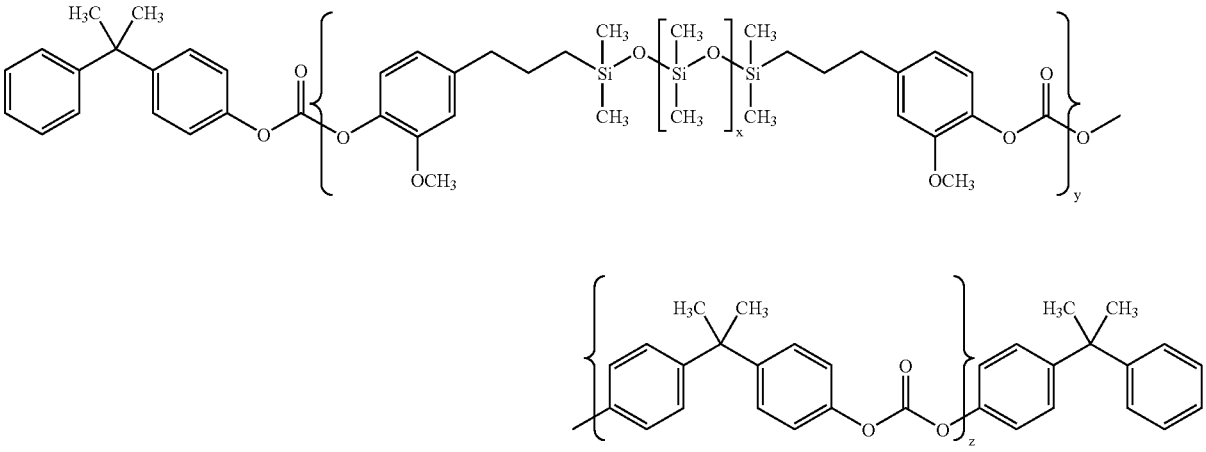

wherein x is an integer representing a number of repeating units of the polydimethyl siloxane present in an amount of from about 2% to about 10% by weight of the total weight of the polymer and, y and z are integers representing a number of repeating units, a modified Bisphenol Z polycarbonate of poly(4,4'-diphenyl-1,1'-cyclohexane carbonate) having polydimethyl siloxane present in the polymer back bone in an amount of from about 2% to about 10% by weight of the total weight of the polymer and having the following formula (II):

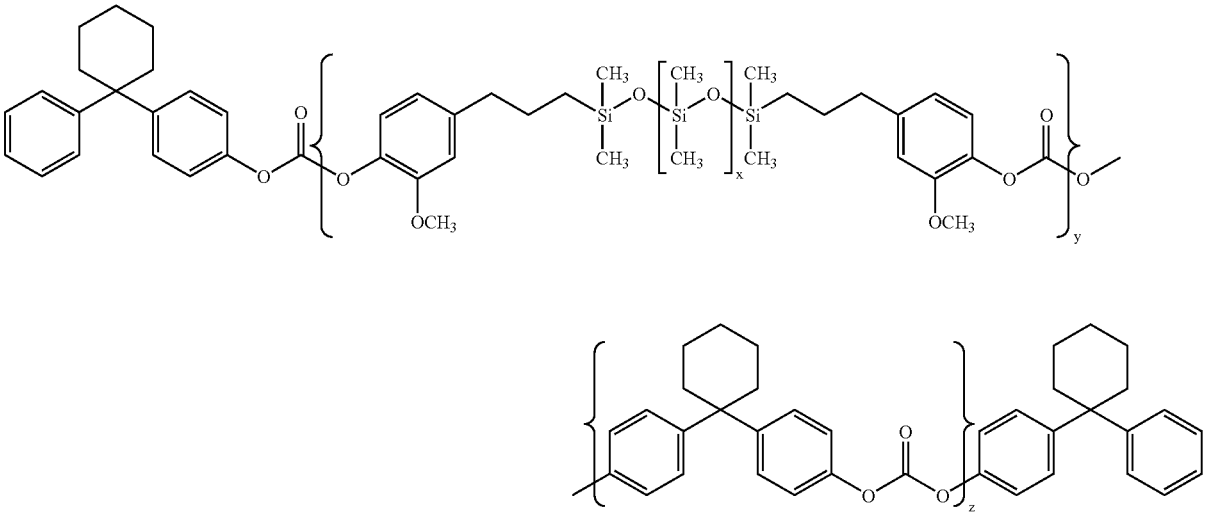

wherein x is an integer representing a number of repeating units of the polydimethyl siloxane present in an amount of from about 2% to about 10% by weight of the total weight of the polymer and, y and z are integers representing a number of repeating units, a modified Bisphenol C polycarbonate of poly(4,4'-isopropylidene diphenyl carbonate) having polydimethyl siloxane present in the polymer back bone in an amount of from about 2% to about 10% by weight of the total weight of the polymer and having the following formula (III):

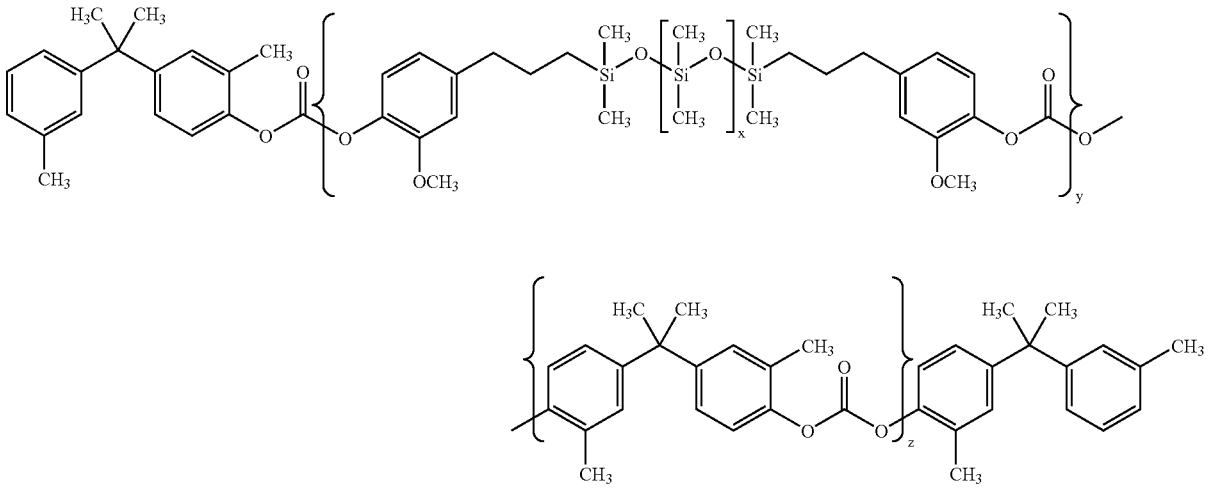

wherein x is an integer representing a number of repeating units of the polydimethyl siloxane present in an amount of from about 2% to about 10% by weight of the total weight of the polymer and, y and z are integers representing a number of repeating units, a Bisphenol Z polycarbonate of poly(4,4'-diphenyl-1,1'-cyclohexane carbonate) having polydimethyl siloxane present in the polymer back bone in an amount of from about 2% to about 10% by weight of the total weight of the polymer and having the following formula (IV):

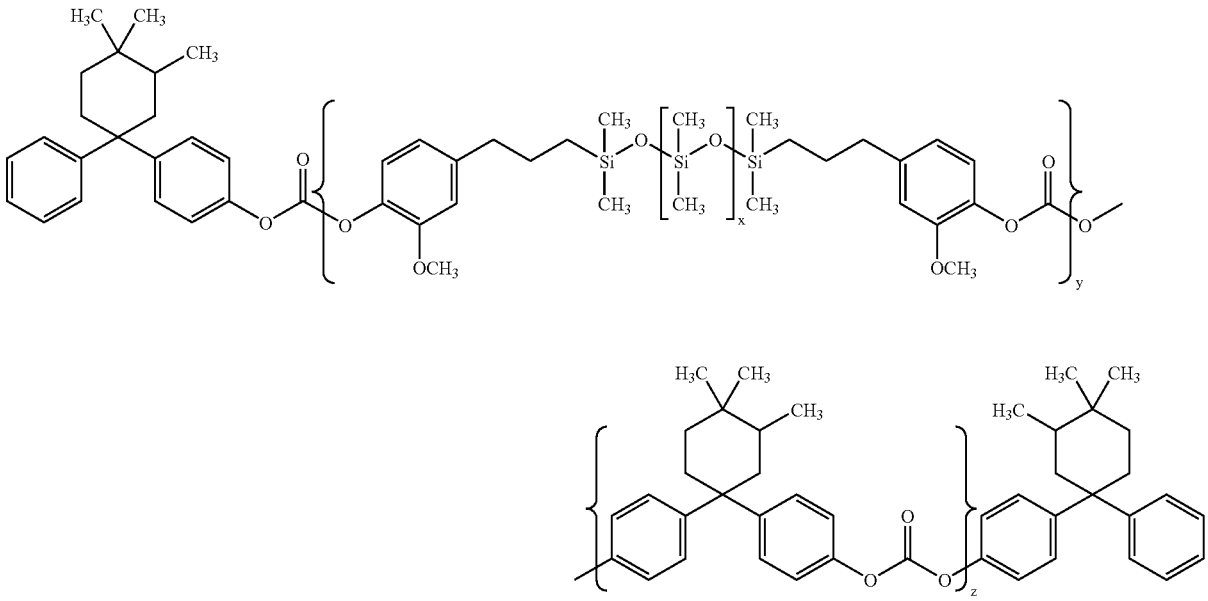

wherein x is an integer representing a number of repeating units of the polydimethyl siloxane present in an amount of from about 2% to about 10% by weight of the total weight of the polymer and, y and z are integers representing a number of repeating units, and mixtures thereof.

13. The image forming apparatus of claim 12, wherein the anticurl back coating includes an adhesion promoter of from about 0.2 percent to about 20 percent, or from about 2 percent to about 10 percent by weight, based on the total weight of the anticurl back coating.

14. The image forming apparatus of claim 11, wherein the polymer has a molecular weight of from about 20,000 to about 200,000.

15. The image forming apparatus of claim 14, wherein the polymer has a molecular weight of from about 25,000 to about 150,000.

16. The image forming apparatus of claim 12, wherein the polydimethyl siloxane is present in an amount of from about 2 percent to about 8 percent by weight of the total weight of the polymer.

17. The image forming apparatus of claim 11, wherein the overcoat layer has a thickness of from about 1 micrometer to about 10 micrometers.

18. The image forming apparatus of claim 17, wherein the overcoat layer has a thickness of from about 2 micrometers to about 6 micrometers.

* * * * *